US011254475B2

(12) United States Patent
Umenaka et al.

(10) Patent No.: US 11,254,475 B2
(45) Date of Patent: Feb. 22, 2022

(54) STRUCTURE OF MOUTH PLUG PORTION, AND PACKAGE

(71) Applicant: HOSOKAWA YOKO CO., LTD., Tokyo (JP)

(72) Inventors: Kazuhiro Umenaka, Fujimino (JP); Hideki Tanaka, Shimoniikawa-gun (JP); Hiroaki Takashima, Shimoniikawa-gun (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 0 days.

(21) Appl. No.: 16/977,946

(22) PCT Filed: Mar. 6, 2019

(86) PCT No.: PCT/JP2019/008950

§ 371 (c)(1),
(2) Date: Oct. 28, 2020

(87) PCT Pub. No.: WO2019/172339

PCT Pub. Date: Sep. 12, 2019

(65) Prior Publication Data

US 2021/0039847 A1 Feb. 11, 2021

(30) Foreign Application Priority Data

Mar. 6, 2018 (JP) ..... JP2018-039504

(51) Int. Cl.
*B65D 47/12* (2006.01)
*B65D 75/58* (2006.01)

(52) U.S. Cl.
CPC ..... *B65D 47/123* (2013.01); *B65D 75/5883* (2013.01); *B65D 2575/586* (2013.01)

(58) Field of Classification Search
CPC ..... B65D 47/123; B65D 75/5883; B65D 2575/586; B65D 41/0485; B65D 41/3447; B65D 41/47; B65D 41/34
See application file for complete search history.

(56) References Cited

U.S. PATENT DOCUMENTS 3,955,696 A 5/1976 Finke
4,171,749 A 10/1979 Obrist et al.
(Continued)

FOREIGN PATENT DOCUMENTS

CL 201301004 4/2013
CN 1541905 11/2004
(Continued)

OTHER PUBLICATIONS

Chinese Office Action in Chinese App. No. 201980016713.8, dated Jul. 28, 2021.
(Continued)

*Primary Examiner* — Donnell A Long
(74) *Attorney, Agent, or Firm* — Nixon Peabody LLP; Jeffrey L. Costellia

(57) ABSTRACT

A structure of a mouth plug portion includes a nozzle and a cap, the nozzle includes a first outer protrusion and a second outer protrusion, the first outer protrusion includes a locking surface that locks the cap and a first guide surface spirally extending, the cap includes a cap body and a tamper band provided with a weak portion that can be broken by an external force received from the second outer protrusion during rotation of the cap body, the cap body includes a first inner protrusion and a second inner protrusion, an outer peripheral surface of the nozzle is provided with a second guide surface along which the first inner protrusion and the second inner protrusion can move in an axial direction.

10 Claims, 13 Drawing Sheets

(56) References Cited

U.S. PATENT DOCUMENTS

| | | | | |
|---|---|---|---|---|
| 4,978,017 | A * | 12/1990 | McBride | B65D 41/3428 215/252 |
| 5,385,252 | A | 1/1995 | Hidding et al. | |
| 5,667,088 | A * | 9/1997 | King | B65D 41/34 215/221 |
| 6,381,928 | B1 * | 5/2002 | Gregory | B65B 7/2835 53/381.4 |
| 2006/0043056 | A1 | 3/2006 | Lee | |
| 2007/0108154 | A1 | 5/2007 | Niwa et al. | |
| 2008/0063319 | A1 | 3/2008 | Kuge et al. | |
| 2008/0135513 | A1 | 6/2008 | Umenaka | |
| 2014/0048537 | A1 * | 2/2014 | McPherson | B65D 49/04 220/276 |
| 2016/0122095 | A1 | 5/2016 | Berge | |
| 2019/0144176 | A1 * | 5/2019 | Yourist | B65D 41/0485 215/217 |
| 2020/0385178 | A1 * | 12/2020 | Shimada | B65D 41/48 |

FOREIGN PATENT DOCUMENTS

| | | |
|---|---|---|
| CN | 1714027 | 12/2005 |
| CN | 1934008 | 3/2007 |
| CN | 101195427 | 6/2008 |
| EP | 2 653 404 | 10/2013 |
| FR | 2892100 | 4/2007 |
| JP | 50-124784 | 10/1975 |
| JP | 54-008081 | 1/1979 |
| JP | 58-149264 | 9/1983 |
| JP | 04-027789 | 7/1992 |
| JP | H7-132952 | 5/1995 |
| JP | 11-180462 | 7/1999 |
| JP | 2004-331124 | 11/2004 |
| WO | WO-2004/094257 | 11/2004 |
| WO | WO-2018/020365 | 2/2018 |

OTHER PUBLICATIONS

International Search Report for PCT/JP2019/008950 dated Jun. 4, 2019.

European Search Report in European App. No. 19763296.1, dated Nov. 2, 2021 (5 pages).

Chilean Office Action for Chilean Pat. App. No. 2020-02278, dated Nov. 2, 2021, 6 pages.

* cited by examiner

STRUCTURE OF MOUTH PLUG PORTION, AND PACKAGE

TECHNICAL FIELD

The present invention relates to a structure of a mouth plug portion, and a package.

Priority is claimed on Japanese Patent Application No. 2018-039504, filed Mar. 6, 2018, the content of which is incorporated herein by reference.

BACKGROUND

A spout-attached pouch that liquid-tightly contains contents formed of a fluid and can easily pour the contents out as necessary is known. In the spout-attached pouch, by a cap detachably fixed to a nozzle provided at the end of the spout, a pouring outlet can be opened and closed.

In order to make a mouth plug portion of the spout configured of the nozzle and the cap have a tamper evidence (tamper proof) structure, an opening-side end of the cap may be provided with a tamper band or the like that is cut by cap-opening operation.

For example, in a structure of a mouth plug portion shown in Patent Document 1, by a male screw formed on an outer peripheral surface of the nozzle being screwed with a female screw formed on an inner peripheral surface of the cap, the cap is detachably fixed to the nozzle. Furthermore, the cap in Patent Document 1 is provided with a band piece that is cut by being caught by a claw portion on the outer periphery of the nozzle when being rotated at the time of opening the cap.

Although it is not a tamper evidence structure, Patent Document 2 shows a lid-attached container that is closed when an undercut portion protruding inward at an opening of the lid is fitted to a locking portion protruding radially outward from a mouth portion. In the lid-attached container, an opening power is obtained when a bulge inside the lid moves along an inclined surface portion provided on the outer periphery of the mouth portion. The lid-attached container can be closed by pressing or striking the lid in the axial direction in a state where the lid covers the mouth portion.

DOCUMENT OF RELATED ART

Patent Document

[Patent Document 1] Japanese Unexamined Patent Application, First Publication No. 2004-331124

[Patent Document 2] Japanese Examined Utility Model Application No. H4-27789

SUMMARY

Technical Problem

However, the above related art has the following problems.

In the technology shown in Patent Document 1, the cap and the nozzle are screwed with each other, so that when the cap is attached and detached, it is necessary to rotate the cap at least about one or two rounds. Therefore, opening and closing may take time and effort. For example, opening and closing may be difficult for children, elderly, patients and the like. Furthermore, the contents may leak if the screwing is insufficient at the time the cap is closed.

In the technology shown in Patent Document 2, since the lid and the mouth portion are not screwed, the amount of rotation of the lid required for opening the lid is small. Particularly, it is possible to close the lid by striking the lid. However, the force required for opening and closing may not be reduced so much because it is necessary to expand the undercut portion each time opening and closing. It is conceivable that a band piece as shown in Patent Document 1 is added to the lid of Patent Document 2, but in this case, at the time of initial opening, a force for expanding the undercut portion and a force for cutting the band piece are required, and thus the required unsealing power further increases.

Furthermore, in the technology shown in Patent Document 2, the inner diameter of the undercut portion increases when the opening and closing are repeated, so that the closing ability may easily deteriorate with the passage of time.

The present invention has been made in view of the above problems, and an object thereof is to provide a structure of a mouth plug portion and a package in which opening and closing operations become easy at the time of initial opening and after the initial opening even if having a tamper evidence structure.

Solution to Problem

In order to solve the above problems, a structure of a mouth plug portion of a first aspect of the present invention is a structure of a mouth plug portion including: a tubular nozzle whose top is provided with an opening; and a cap that is detachably fitted to an outer periphery and the top of the nozzle and closes the opening when being attached to the nozzle, wherein the nozzle includes: a first outer protrusion provided partially in a circumferential direction of an outer peripheral surface of the nozzle at a position away from the top in an axial direction and protruding outward in a radial direction, and a second outer protrusion provided at a position further than the first outer protrusion in the axial direction with respect to the top and protruding outward in the radial direction from the outer peripheral surface of the nozzle, the first outer protrusion includes: a locking surface that locks the cap such that the cap is prevented from being pulled out, and a first guide surface spirally extending between the locking surface and the top, the cap includes: a cap body configured to be attached to the nozzle so as to cover the first outer protrusion and the opening, and a tamper band connected to a base end side of the cap body and formed into an annular shape that laterally covers the second outer protrusion when the cap body is attached to the nozzle, part of the tamper band in the circumferential direction being provided with a weak portion configured to be broken by an external force received from the second outer protrusion when the cap body is rotated, the cap body includes: a first inner protrusion that protrudes inward in the radial direction from an inner peripheral surface thereof and is configured to be locked on the locking surface when the cap body is attached to the nozzle, and a second inner protrusion that protrudes inward in the radial direction from the inner peripheral surface and is provided so as to be movable along the first guide surface in a state where the first inner protrusion is not locked on the locking surface, and the outer peripheral surface of the nozzle is provided with a second guide surface along which the first inner protrusion and the second inner protrusion move in the axial direction during attachment/detachment of the cap.

In the structure of a mouth plug portion of the first aspect, the nozzle may further include a third outer protrusion forming a fitting gap between the third outer protrusion and a top-side end that is one of two ends of the first outer protrusion in the circumferential direction, the first guide surface at the top-side end may be closer to the top than the other end of the two ends, and the fitting gap may allow the second inner protrusion of the cap body to be removably fitted thereinto.

In the structure of a mouth plug portion of the first aspect, the first inner protrusion may be formed of a protrusion piece extending diagonally inward in the radial direction from a base end of the cap body.

In the structure of a mouth plug portion of the first aspect, a base end-side end may be one of two ends of the first outer protrusion in the circumferential direction, the first guide surface at the base end-side end may be further than the first guide surface at the other end of the two ends with respect to the top, and a protrusion amount of the first outer protrusion outward in the radial direction at the base end-side end and in the vicinity of the base end-side end gradually may increase from the base end-side end to the other end on a distant side from the base end-side end in the circumferential direction.

In the structure of a mouth plug portion of the first aspect, an outer shape of the cap body when viewed in the axial direction of the cap body may have a flat shape as a whole.

In the structure of a mouth plug portion of the first aspect, an outer shape of the cap body when viewed in the axial direction may be formed into an elliptical shape by an outer peripheral surface of the cap body being provided with a plurality of ribs extending in the axial direction and having different protrusion amounts in the radial direction.

In the structure of a mouth plug portion of the first aspect, the outer peripheral surface of the cap body may include a first outer peripheral surface on a top side in the axial direction and a second outer peripheral surface on a base end side in the axial direction, the outer diameter of the first outer peripheral surface may be less than that of the second outer peripheral surface, and part of the second outer peripheral surface with which a minor axis of the elliptical shape intersects may be a rib-less area provided with no ribs.

In the structure of a mouth plug portion of the first aspect, the first outer protrusion may include a pair of first outer protrusions provided in the nozzle, the second outer protrusion may include a pair of second outer protrusions provided in the nozzle, and each pair of the first outer protrusions and the second outer protrusions may have 180° rotationally symmetry in the circumferential direction such that the second guide surface is disposed therebetween, and the first inner protrusion and the second inner protrusion of the cap body may be formed within a range less than or equal to a width of the second guide surface in the circumferential direction of the nozzle, the first inner protrusion may include a pair of first inner protrusions provided in the cap body, the second inner protrusion may include a pair of second inner protrusions provided in the cap body, and each pair of the first inner protrusions and the second inner protrusions may have 180° rotationally symmetry in the circumferential direction of the cap body.

In the structure of a mouth plug portion of the first aspect, the nozzle may further include an auxiliary protrusion, and the auxiliary protrusion may include an inclined guide surface, the inclined guide surface may extend from a position between the first outer protrusion and the second outer protrusion in the axial direction toward a base end-side end that is one of two ends of the first outer protrusion in the circumferential direction, the first guide surface at the base end-side end may be further than the first guide surface at the other end of the two ends with respect to the top, and the first inner protrusion may be movable while being into contact with the inclined guide surface.

A package of a second aspect of the present invention incudes the structure of a mouth plug portion of the first aspect.

Effects

According to a structure of a mouth plug portion and a package of the present invention, opening and closing operations become easy at the time of initial opening and after the initial opening even if they have a tamper evidence structure.

DESCRIPTION OF EMBODIMENTS

First Embodiment

Hereinafter, a first embodiment of the present invention will be described with reference to the attached drawings.

Figure 1:
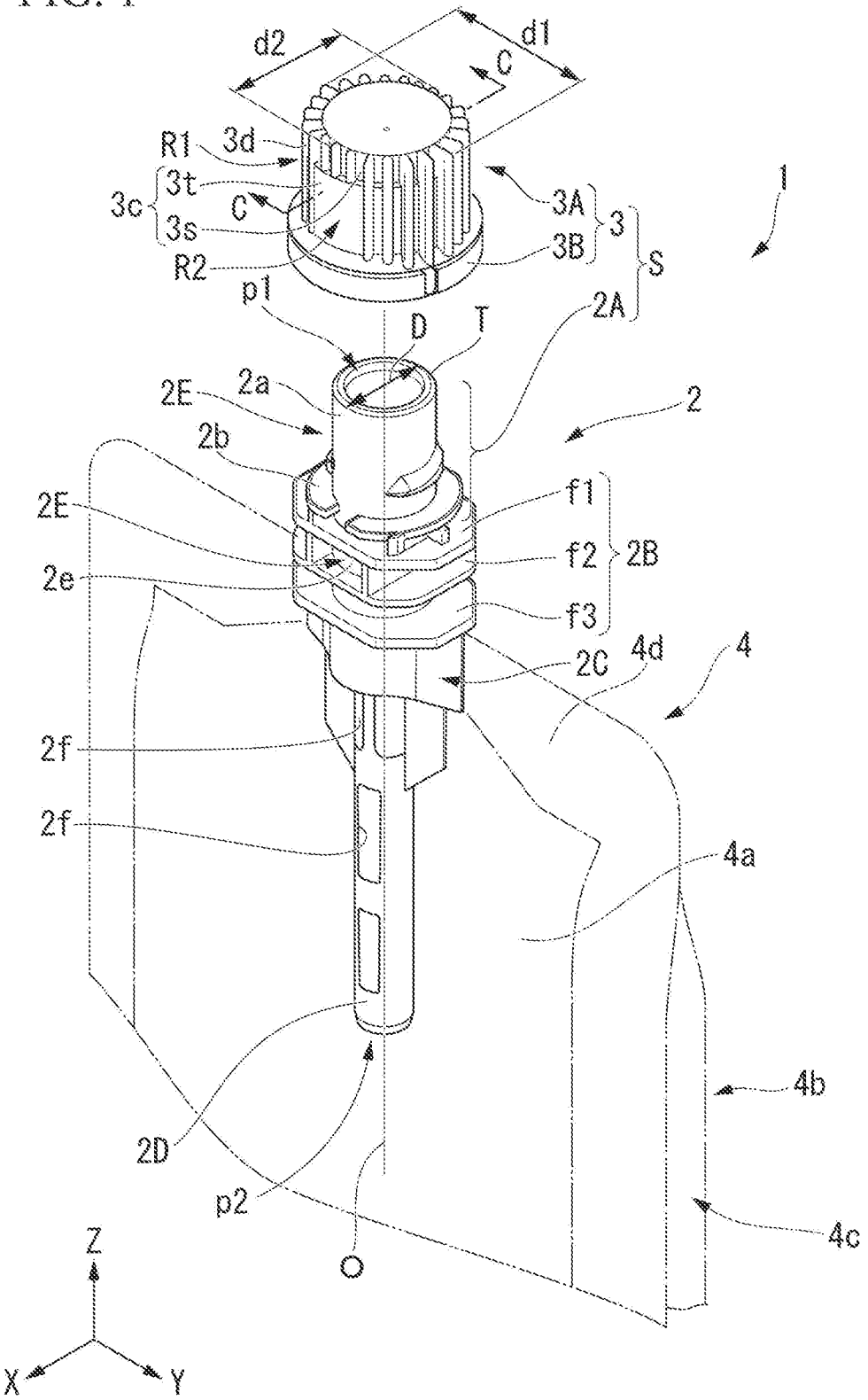
FIG. 1 is a schematic exploded perspective view showing an example of a package including a structure of a mouth plug portion of a first embodiment of the present invention.
Figure 2:
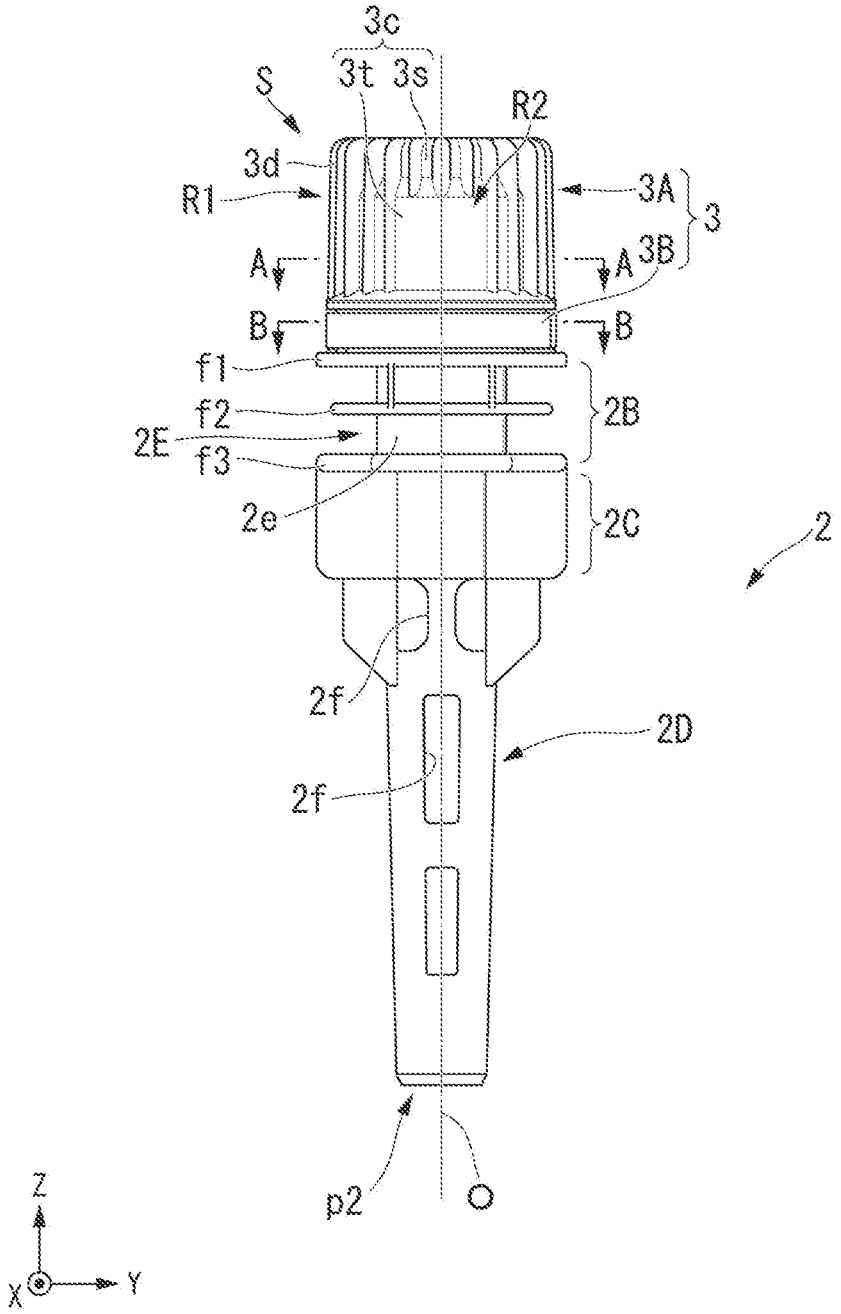
FIG. 2 is a schematic front view before opening the mouth plug portion of the first embodiment of the present invention.
Figure 3:
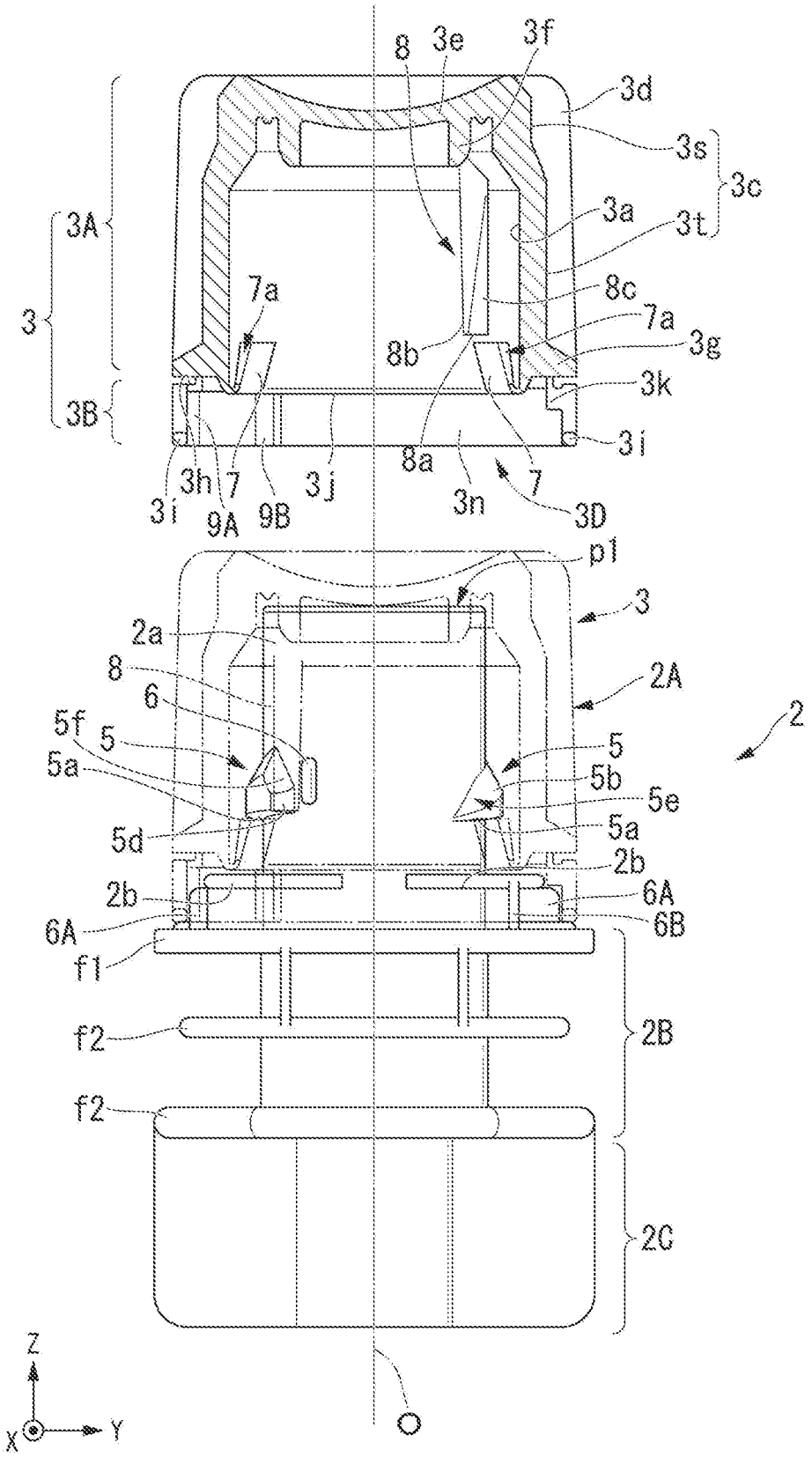
FIG. 3 is a schematic exploded view from the front showing a detailed configuration of a cap and a nozzle of the mouth plug portion of the first embodiment of the present invention.
Figure 4:
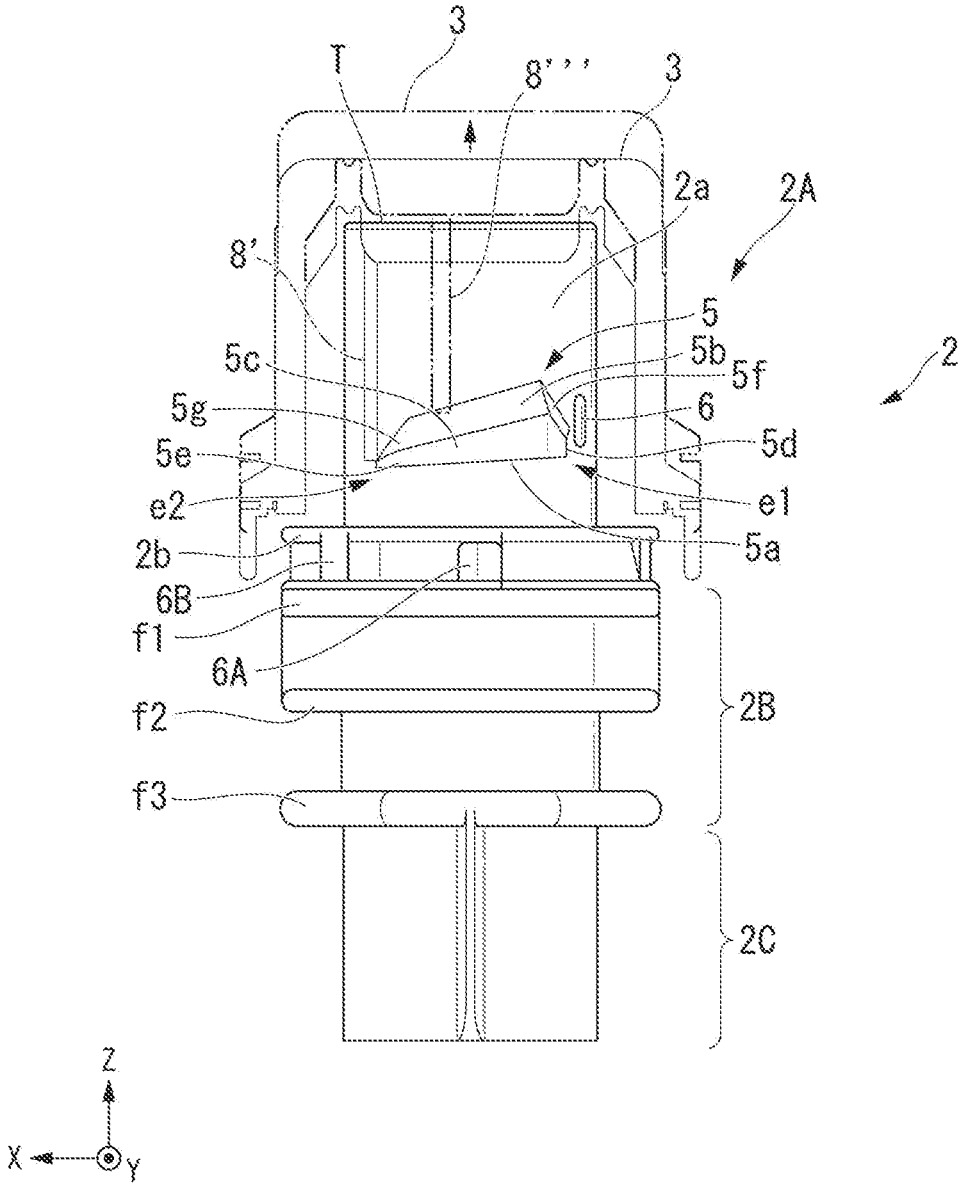
FIG. 4 is a schematic side view of the nozzle of the mouth plug portion of the first embodiment of the present invention.
Figure 5:
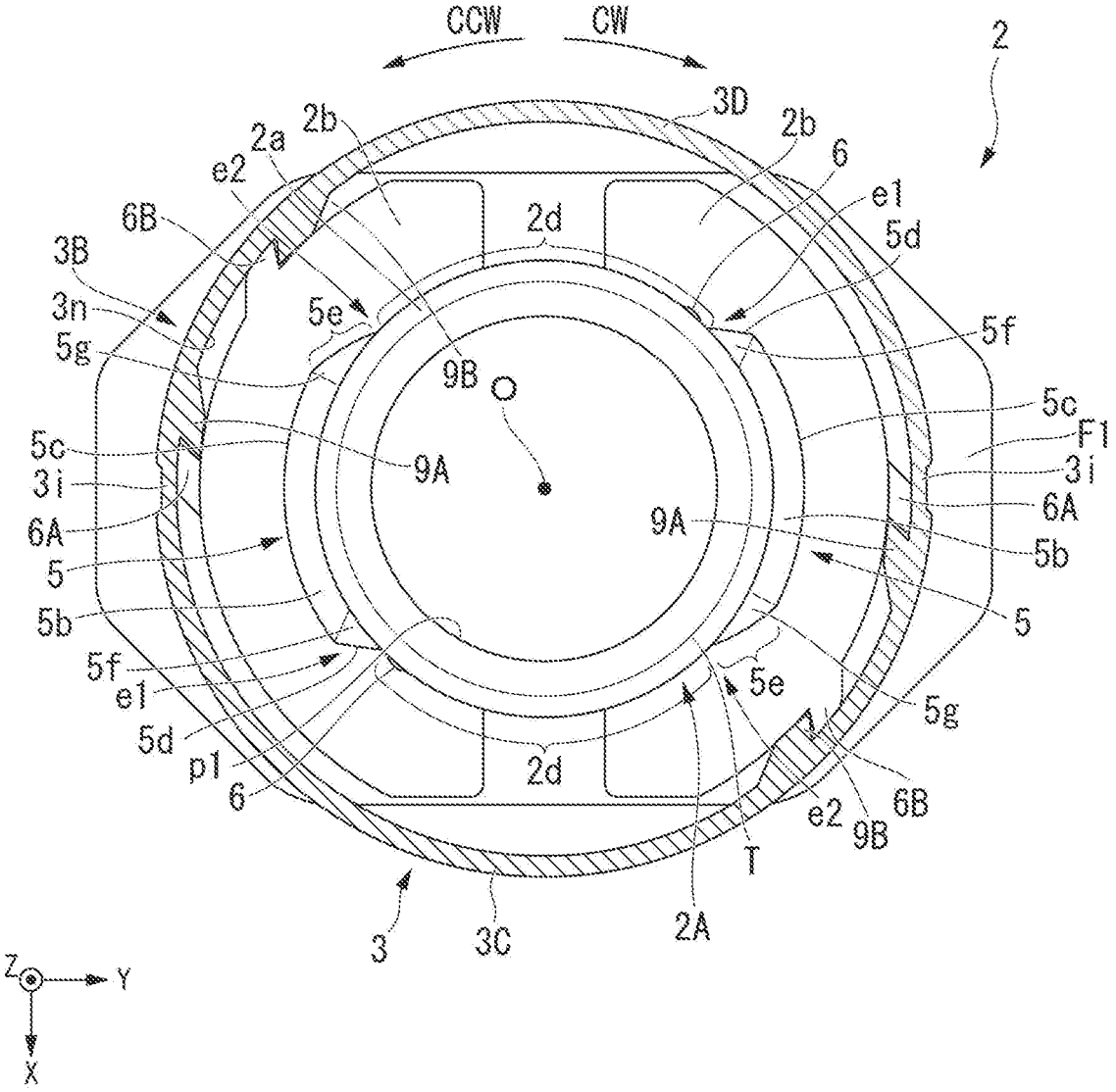
FIG. 5 is a schematic plan view of the nozzle of the mouth plug portion of the first embodiment of the present invention.
Figure 6:
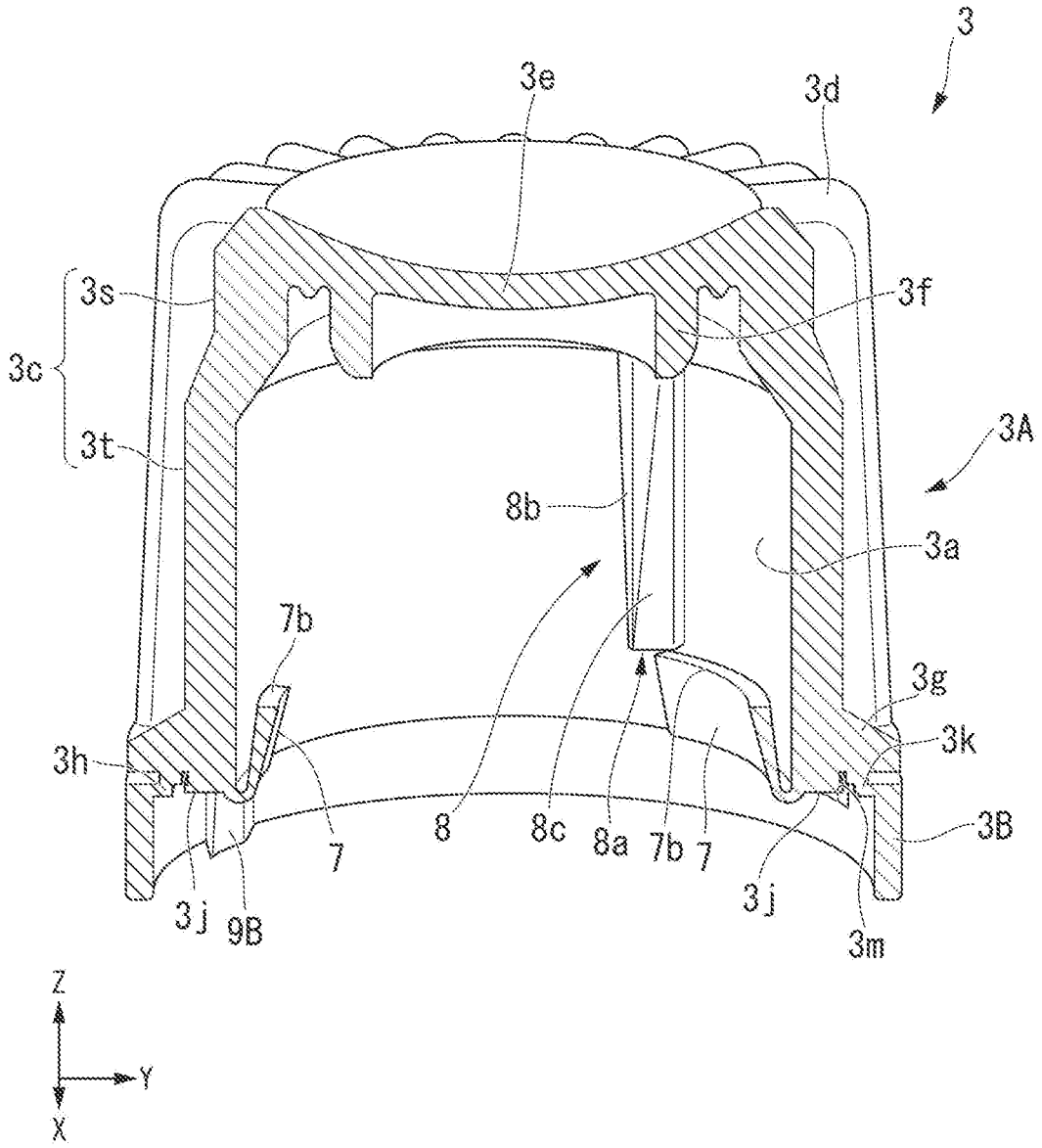
FIG. 6 is a schematic perspective partial cross-sectional view of the cap of the mouth plug portion of the first embodiment of the present invention.
Figure 7:
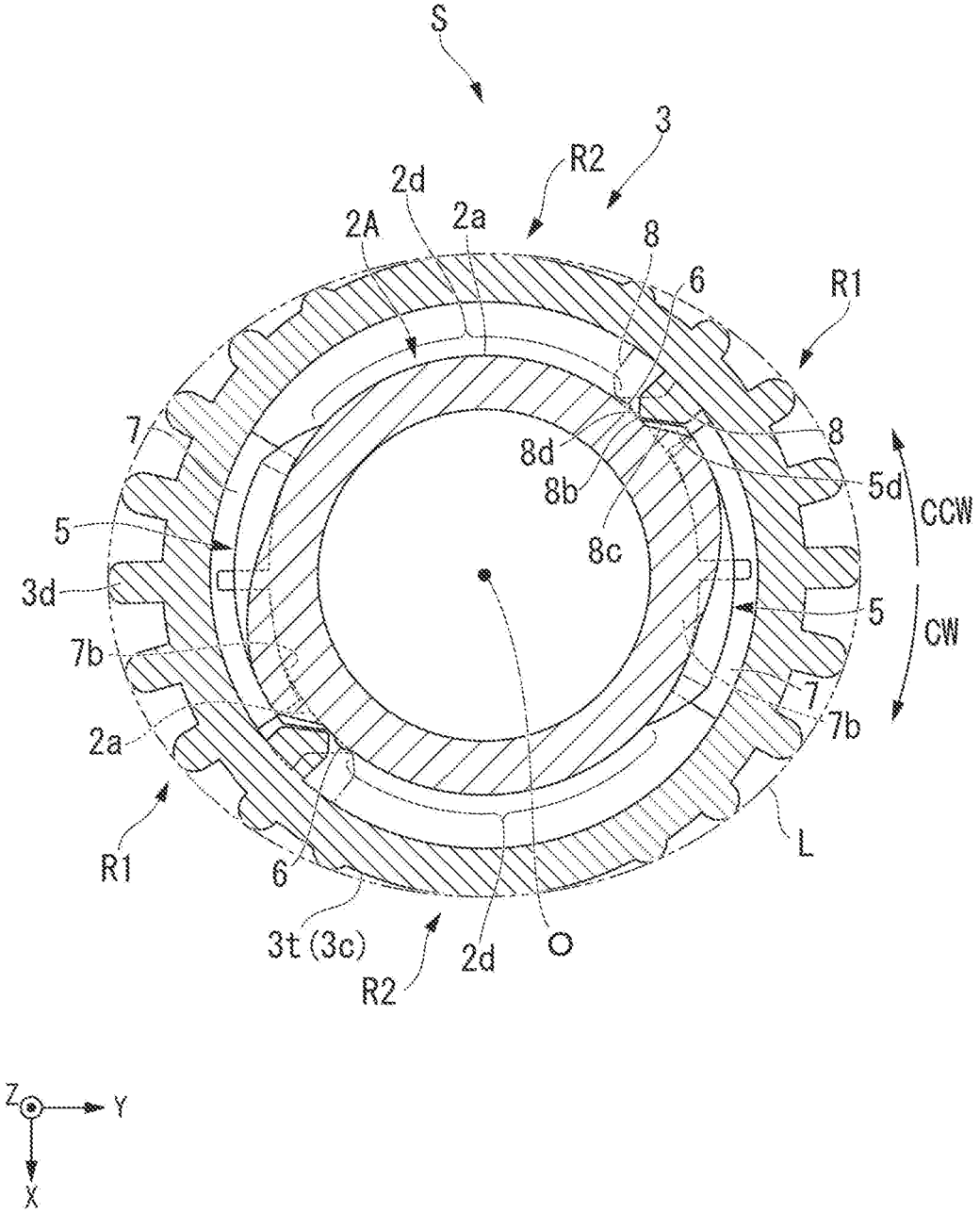
FIG. 7 is a cross-sectional view taken along line A-A in FIG. 2.
Figure 8:
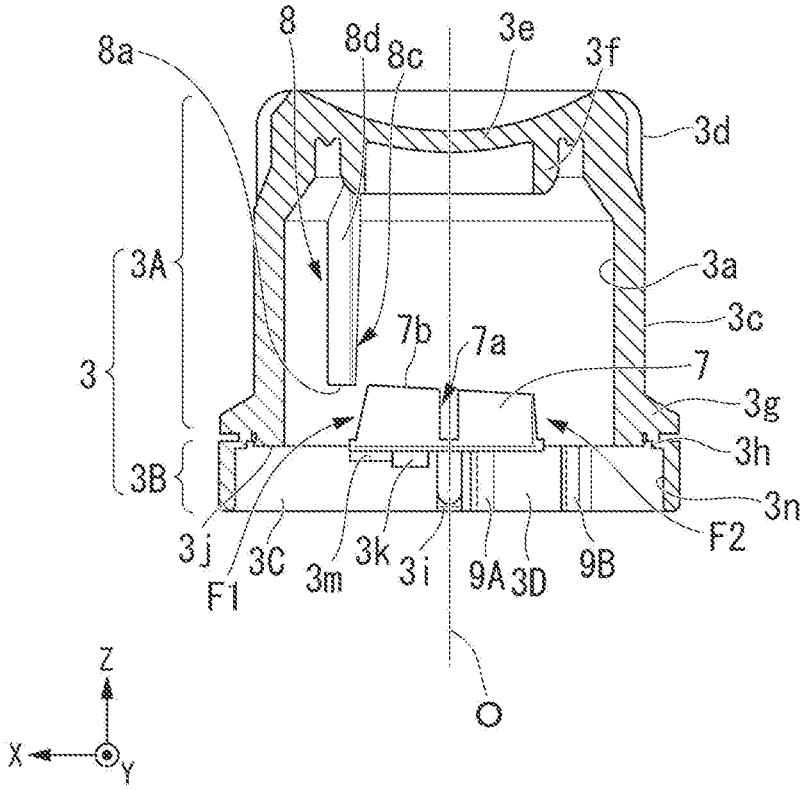
FIG. 8 is a cross-sectional view taken along line C-C of FIG. 1.

FIG. 1 is a schematic exploded perspective view showing an example of a package including a structure of a mouth plug portion of the first embodiment of the present invention. FIG. 2 is a schematic front view before opening the mouth plug portion of the first embodiment of the present invention. FIG. 3 is a schematic exploded view from the front showing a detailed configuration of a cap and a nozzle of the mouth plug portion of the first embodiment of the present invention. FIG. 4 is a schematic side view of the nozzle of the mouth plug portion of the first embodiment of the present invention. FIG. 5 is a schematic plan view of the nozzle of the mouth plug portion of the first embodiment of the present invention. FIG. 6 is a schematic perspective partial cross-sectional view of the cap of the mouth plug portion of the first embodiment of the present invention. FIG. 7 is a cross-sectional view taken along line A-A in FIG. 2. FIG. 8 is a cross-sectional view taken along line C-C of FIG. 1.

A spout-attached pouch 1 (corresponding to a package of the present invention) of this embodiment as shown in FIG. 1 is a container that contains contents formed of a fluid such that the contents can be poured out from a pouring outlet described later. The contents contained in the spout-attached pouch 1 are not particularly limited as long as the contents are a fluid. Examples of the contents contained in the spout-attached pouch 1 include beverages, fluid foods, retort foods, food ingredients, liquid seasonings, liquid medicines and the like.

The spout-attached pouch 1 includes a container body 4, a spout 2, and a cap 3.

Since FIG. 1 is an exploded perspective view, the spout 2 and the cap 3 are shown away from each other, but as shown in FIG. 2, in an unopened state of the cap 3, the cap 3 is engaged with the spout 2 in a state of covering an end of the spout 2.

In this embodiment, in an axial direction along a central axis O of the spout 2, a side of the spout-attached pouch 1 where the cap 3 is provided may be referred to as an upper side, a side of the spout-attached pouch 1 where the container body 4 is provided may be referred to as a lower side, a direction intersecting with the central axis O may be referred to as a radial direction, and a direction around the central axis O may be referred to as a circumferential direction.

The configuration of the container body 4 is not particularly limited as long as the container body 4 can liquid-tightly contain the contents and allows the spout 2 described later to be fixed thereto. For example, for the container body 4, a side gusset bag, a bottom gusset bag, a bag having gussets on the sides and the bottom, a pillow bag, a flat bag, or the like may be used.

In the example shown in FIG. 1, a side gusset bag is used for the container body 4. That is, in the container body 4, side films 4*c* each folded in half are sandwiched between a front film 4*a* and a rear film 4*b* overlapping the front film 4*a*.

Each peripheral edge of the front film 4*a*, the rear film 4*b*, and the side films 4*c* is heat-sealed.

An upper end of the container body 4 is provided with an upper seal 4*d* that adheres the front film 4*a*, the rear film 4*b*, and the side films 4*c* to each other in a state where the spout 2 described later is sandwiched in a center portion of the upper end.

The spout 2 is an elongated tubular member as a whole. In the spout 2, a nozzle 2A, a flange portion 2B, an attachment portion 2C, and a conduit portion 2D are arranged in this order. The nozzle 2A, the flange portion 2B, and the conduit portion 2D are arranged coaxially with the central axis O of the spout 2. The cap 3 when being attached to the spout 2 and a cap body 3A described later are also arranged coaxially with the central axis O.

Hereinafter, an XYZ rectangular coordinate system may be referred to when the relative positional relationship of each part of the spout-attached pouch 1 is described. A Z-axis is an axis parallel to the central axis O. That is, a Z-axis direction is the same as the axial direction. A Y-axis is an axis orthogonal to the Z-axis and parallel to a sealing surface of the upper seal 4*d*. An X-axis is an axis orthogonal to the Z-axis and the Y-axis.

In the central axis O, a direction from the conduit portion 2D toward the nozzle 2A is a Z-axis positive direction. An X-axis positive direction is a direction along the X-axis from the rear film 4*b* toward the front film 4*a*. A Y-axis positive direction is a direction from left to right when the Z-axis positive direction is aligned with a vertically upward direction and the spout-attached pouch 1 is seen in the X-axis negative direction. A view of the spout-attached pouch 1 in the X-axis negative direction may be referred to as a front view, and a view of the spout-attached pouch 1 in a Y-axis direction may be referred to as a side view.

Hereinafter, unless otherwise noted, the positional relationship of each part will be described based on the positional relationship in the unopened state even if the part is a member such as the cap 3 removable from the spout 2.

As shown in FIG. 1, the nozzle 2A is tubular and is provided with a through-hole through which the contents contained in the container body 4 are poured out. The through-hole opens at a top T (on the upper side in the diagram) of the nozzle 2A. Therefore, a pouring outlet p1 is open at the top of the nozzle 2A. The opening shape of the pouring outlet p1 is a circle centered on the central axis O.

An outer peripheral surface 2*a* of the nozzle 2A is formed of a cylindrical surface having a diameter D and centered on the central axis O.

In this embodiment, a main body of the nozzle 2A is formed of a cylindrical tube 2E having the above outer peripheral surface 2*a* and the pouring outlet p1 formed at an end thereof. The cylindrical tube 2E passes through central portions of the flange portion 2B and the attachment portion 2C described later and is connected to the conduit portion 2D described later. The tube diameter of the cylindrical tube 2E may be fixed. However, the outer diameter of an outer peripheral surface 2*e* of the cylindrical tube 2E at the flange portion 2B and the attachment portion 2C may be different from the outer diameter of the outer peripheral surface 2*a* at the nozzle 2A.

The end of the nozzle 2A on a distant side from the pouring outlet p1 in the axial direction is provided with a plate-shaped portion 2*b* protruding outward in the radial direction from the outer peripheral surface 2*a*. The end of the nozzle 2A on a distant side from the pouring outlet p1 in the axial direction may be referred to as a base end.

The detailed structure of the nozzle 2A will be described later.

The flange portion 2B is provided to be adjacent to a trailing side of the plate-shaped portion 2*b* in the Z-axis negative direction. The flange portion 2B includes a first flange f1, a second flange f2, and a third flange f3 that protrude laterally (outward in the radial direction) from the outer peripheral surface 2*e* of the cylindrical tube 2E. The outer shape of each of the first flange f1, the second flange f2, and the third flange f3 in plan view (when viewed in the Z-axis direction) is, for example, an octagonal shape. The outer shapes of the first flange f1, the second flange f2, and the third flange f3 are the same. The outer shapes of the first flange f1, the second flange f2, and the third flange f3 protrude outward from the outer shape of the plate-shaped portion 2*b* in plan view. As shown in FIG. 2, a gap is provided so as to penetrate between the first flange f1 and the second flange f2 at least in the X-axis direction, and another gap is provided so as to penetrate between the second flange f2 and the third flange f3 at least in the X-axis direction.

The width of the flange portion 2B in the Z-axis direction has a size sufficient for a user of the spout-attached pouch 1 to hold the spout 2 with fingers thereof in the X-axis direction.

As shown in FIG. 1, in the spout 2, the attachment portion 2C is a portion for liquid-tightly adhering the front film 4*a* and the rear film 4*b* at the upper edge portions thereof shown in the diagram.

The attachment portion 2C is provided to be adjacent to a trailing side of the third flange f3 of the flange portion 2B in the Z-axis negative direction. The attachment portion 2C extends from the outer peripheral surface 2*e* of the cylindrical tube 2E in the Y-axis direction. The attachment portion 2C extends in a plate shape having plane symmetry with respect to a plane through which the central axis O passes and which is parallel to the Y-Z plane. The width of the attachment portion 2C in the X-axis direction gradually decreases in a direction away from the outer peripheral surface 2*e*. The width in the X-axis direction of the tip in the extending direction of the attachment portion 2C is about 0.1 to 0.5 mm that is an extent in which adhering between the front film 4*a* and the rear film 4*b* is not affected. That is, the front film 4*a* and the rear film 4*b* that have been adhered with the attachment portion 2C interposed therebetween have no step at the tip of the attachment portion 2C. Therefore, the tip in the Y-axis direction of the attachment portion 2C and the upper seal 4*d* can be liquid-tightly adhered.

The attachment portion 2C is formed in a size that is included in the outer shape of the flange portion 2B when viewed in the Z-axis direction.

The conduit portion 2D is a portion that is inserted into the container body 4 and forms a conduit that guides the contents in the container body 4 to the pouring outlet p1 of the nozzle 2A.

The conduit portion 2D is not particularly limited in thickness, length and shape of the conduit as long as the conduit portion 2D communicates with the cylindrical tube 2E. For example, the conduit portion 2D may be a tubular portion having the same shape as the cylindrical tube 2E, a tubular portion whose diameter is greater than that of the cylindrical tube 2E, or a tubular portion whose diameter is less than the cylindrical tube 2E. For example, the conduit cross-section of the conduit portion 2D may have a flat shape.

In this embodiment, the conduit portion 2D is formed in an elongated cylindrical shape extending along the central axis O from the cylindrical tube 2E extending to the attachment portion 2C. The conduit portion 2D gradually decreases in diameter toward the end (lower end) in the extending direction thereof. Therefore, an opening p2 at the end of the conduit portion 2D has an opening area less than that of the pouring outlet p1.

In this embodiment, a plurality of holes 2*f* are provided on the side surface of the conduit portion 2D such that the contents in the container body 4 can smoothly flow to the pouring outlet p1. This allows the contents in the container body 4 to flow into the conduit portion 2D from each hole 2*f* in addition to the opening p2.

In the spout 2 having such a configuration, at least the surface of the attachment portion 2C is made of a resin material that can be adhered to the front film 4*a* and the rear film 4*b* of the container body 4. The resin material used for the attachment portion 2C is more preferably a material that can adhere the front film 4*a* and the rear film 4*b* by heat-sealing.

In this embodiment, the entire spout 2 including the attachment portion 2C is made of a material that can adhere the front film 4*a* and the rear film 4*b* by heat-sealing. Examples of such a resin material include synthetic resin such as high-density polyethylene, low-density polyethylene, linear low-density polyethylene, and polypropylene.

Here, the structure of the nozzle 2A will be described in detail.

As shown in FIGS. 3 and 4, the outer peripheral surface 2*a* of the nozzle 2A is provided with guide protrusions 5 (first outer protrusion) and engagement protrusions 6 (third outer protrusion).

The guide protrusion 5 is an arc-shaped protrusion extending in the circumferential direction of the outer peripheral surface 2*a*. The number of the guide protrusions 5 is not particularly limited as long as it is 1 or more. Hereinafter, an example where the number of the guide protrusions 5 is two will be described.

As shown in FIG. 5, the guide protrusions 5 have an equal shape. The guide protrusions 5 are provided so as to have a positional relationship of 180° rotational symmetry with the central axis O as the axis of symmetry.

In the example shown in FIG. 5, the length of each guide protrusion 5 in the circumferential direction is slightly less than ¼ of the circumference of the outer peripheral surface 2*a*. That is, a central angle of each guide protrusion 5 with respect to the central axis O is slightly less than 90°. In this embodiment, the central angle refers to an angle between two straight lines that pass from the central axis O to two ends in the circumferential direction of an object such as the guide protrusion 5.

However, as long as attachment/detachment of the cap 3 described later can be performed, the central angle of each guide protrusion 5 with respect to the central axis O can be an appropriate angle greater than 0° and less than 180° as necessary.

In a case where the number of the guide protrusions 5 is two, the central angle of each guide protrusion 5 with respect to the central axis O is more preferably 45° or more and 90° or less.

If the central angle is less than 45°, the amount of movement of the cap 3 in the Z-axis direction and the force to the cap 3, required for unsealing, may not be obtained. In addition, the pulling-out-proof strength of the guide protrusion 5 during attachment of the cap 3 may be insufficient.

If the central angle exceeds 90', the rotation amount of the cap 3 for opening and attachment/detachment increases, which may make it difficult to remove the cap 3. In addition, since it is necessary to decrease the length in the circumferential direction of an engaging portion of the cap 3, the pulling-out-proof strength of the engaging portion of the cap 3 during attachment of the cap 3 may be insufficient.

As shown in FIG. 4, the guide protrusion 5 is disposed at a position away from the top T in the axial direction. The guide protrusion 5 is provided partially in the circumferential direction of the outer peripheral surface 2*a* of the nozzle 2A and protrudes outward in the radial direction. In this embodiment, the guide protrusion 5 extends from a first end e1 (corresponding to the top-side end of the present invention) to a second end e2 (corresponding to the base end-side end of the present invention) in the circumferential direction in the outer peripheral surface 2*a* between the plate-shaped portion 2*b* and the top T.

As shown in FIG. 5, the first end e1 is an end in a counterclockwise direction when the nozzle 2A is viewed in the Z-axis negative direction. In other words, the first end e1 is an end on a leading side of the guide protrusion 5 in a clockwise direction when the nozzle 2A is viewed in the Z-axis negative direction. The second end e2 is an end in the clockwise direction when viewed similarly. In other words, the second end e2 is an end on a trailing side of the guide protrusion 5 in the clockwise direction when the nozzle 2A is viewed in the Z-axis negative direction. In this embodiment, the clockwise direction is a direction in which the cap 3 is rotated in order to close the nozzle 2A, and the counterclockwise direction is a direction in which the cap 3 is rotated in order to open the nozzle 2A.

A side surface 5*c* of the guide protrusion 5 is a cylindrical surface coaxial with the outer peripheral surface 2*a*. The side surface 5*c* is a radially outer surface of the guide protrusion 5. However, the side surface of the guide protrusion 5 close to the first end e1 is provided with an inclined end surface 5*d* that inclines from the side surface 5*c* toward the outer peripheral surface 2*a* as going from the second end e2 to the first end e1. The inclined end surface 5*d* is provided in order to lock a second inner protrusion of the cap 3 described later.

The side surface of the guide protrusion 5 close to the second end e2 is provided with an inclined portion 5*e* that gradually inclines from the outer peripheral surface 2*a* to the side surface 5*c* as going from the second end e2 to the first end e1. The average inclination angle of the inclined portion 5*e* in plan view is less than that of the inclined end surface 5*d*. That is, the inclination angle of the inclined portion 5*e* with respect to the outer peripheral surface 2*a* is less than the inclination angle of the inclined end surface 5*d* with respect to the outer peripheral surface 2*a*.

As shown in FIG. 4, a lower surface 5*a* (locking surface) of the guide protrusion 5 faces the plate-shaped portion 2*b*. A gap into which a first inner protrusion of the cap 3 described later can be fitted so as to be movable in the circumferential direction is provided between the plate-shaped portion 2*b* and the lower surface 5*a*. The lower surface 5*a* can lock the first inner protrusion in the axial direction when the first inner protrusion of the cap 3 described later enters thereunder.

In this embodiment, the gap between the plate-shaped portion 2*b* and the lower surface 5*a* is slightly reduced from the first end e1 to the second end e2. However, the gap between the plate-shaped portion 2*b* and the lower surface 5*a* may be constant.

An upper surface 5*b* (first guide surface) is provided on a distant side of the guide protrusion 5 from the lower surface 5*a* in the axial direction. The upper surface 5*b* extends in a spiral shape (upward-rightward spiral shape shown in the diagram) gradually approaching from the lower surface 5*a* toward the top T as going from the second end e2 toward the first end e1. However, the upper surface 5*b* is not limited to a strict spiral surface as long as the distance from the plate-shaped portion 2*b* to the upper surface 5*b* smoothly changes. The upper surface 5*b* is formed of an appropriate curved surface that smoothly changes in a spiral shape. For example, in the example shown in FIG. 4, the upper surface 5*b* is formed of a curved surface that extends in a spiral shape in the circumferential direction and that inclines toward the lower surface 5*a* as going from the inner side toward the outer side thereof in the radial direction. The upper surface 5*b* inclines toward the top T as going in the counterclockwise direction.

The first end e1 side of the upper surface 5*b* is provided with a first inclined surface 5*f* that extends from the upper surface 5*b* toward the lower surface 5*a* as going from the second end e2 to the first end e1.

The second end e2 side of the upper surface 5*b* is provided with, in a range in which the inclined portion 5*e* is provided on the side surface, a second inclined surface 5*g* that extends from the lower surface 5*a* toward the upper surface 5*b* as going from the second end e2 toward the first end e1. The average inclination of the second inclined surface 5*g* when viewed laterally is greater than the inclination of the upper surface 5*b* in the circumferential direction. In other words, the inclination angle of the second inclined surface 5*g* with respect to a plane orthogonal to the axial direction is greater than that of the upper surface 5*b* with respect to the plane.

As shown in FIG. 5, the engagement protrusion 6 is provided at a position adjacent to the inclined end surface 5*d* of each guide protrusion 5 with a gap therebetween. As shown in FIGS. 3 and 4, each engagement protrusion 6 extends in the Z-axis direction in a range facing the inclined end surface 5*d* and the first inclined surface 5*f* in the circumferential direction. The engagement protrusion 6 is provided to protrude outward in the radial direction from the outer peripheral surface 2*a* of the nozzle 2A.

As shown in FIG. 5, the shape of each engagement protrusion 6 in a cross-section parallel to the X-Y plane has an arc shape.

The protrusion height of the engagement protrusion 6 is set to an appropriate height such that the user feels a click at the time the pouring outlet p1 is closed by the cap 3 described later. For example, the protrusion height of the engagement protrusion 6 may be 0.05 mm or more and 1.0 mm or less. The protrusion height of the engagement protrusion 6 may change in the Z direction.

With such a configuration, in a cross-section in the circumferential direction, a substantially V-shaped shallow groove (fitting gap) is provided between the engagement protrusion 6 and the inclined end surface 5*d* of the guide protrusion 5. The shape of the fitting gap in a cross-section in a direction orthogonal to the axial direction is not limited to a V shape but may be a U shape.

The outer peripheral surface 2*a* between the guide protrusions 5 adjacent to each other in the circumferential direction configures a second guide surface 2*d* on which the cap 3 described later can move in the Z-axis direction during attachment/detachment thereof.

As shown in FIG. 5, the plate-shaped portion 2*b* is formed of two C-shaped portions in plan view that face each other in the Y-axis direction. The shapes of the C-shaped portions of the plate-shaped portion 2*b* have 180° rotational symmetry with the central axis O as the axis of symmetry.

A first ratchet 6A (second outer protrusion) and a second ratchet 6B (second outer protrusion) protrude outward in the radial direction on the outer periphery of each plate-shaped portion 2*b*. Therefore, the first ratchet 6A and the second ratchet 6B are provided at positions further away from the guide protrusion 5 in the axial direction and protrude outward in the radial direction from the outer periphery of the nozzle 2A.

The first ratchet 6A and the second ratchet 6B are provided in order to apply an external force to a tamper band to break the tamper band when the cap 3 described later is opened.

The first ratchet 6A is provided at each of two positions, and the positions overlap, in the radial direction, middle portions of the guide protrusions 5 in the circumferential direction. The first ratchet 6A has a plan view shape that inclines so as to extend outward in the radial direction as going in the clockwise direction when the nozzle 2A is viewed in the Z-axis negative direction. In the first ratchet 6A, such a plan view shape extends in the Z-axis direction.

The second ratchet 6B is provided at each of two positions, and the positions overlap, in the radial direction, the second ends e2 of the guide protrusions 5. The second ratchet 6B has a plan view shape that inclines so as to extend outward in the radial direction as going in the clockwise direction when the nozzle 2A is viewed in the Z-axis negative direction. In the second ratchet 6B, such a plan view shape extends in the Z-axis direction.

As shown in FIG. 1, the cap 3 is a plug member that is detachably fixed to the spout 2 in order to liquid-tightly seal the pouring outlet p1 of the spout 2.

The cap 3 includes the cap body 3A having a cylindrical shape with a top, and a tamper band 3B.

As shown in FIG. 3, the cap 3 is formed in a cylindrical shape with a top that opens downward in the diagram.

Each of inner peripheral surfaces 3*a* and 3*n* of the cap body 3A and the tamper band 3B, respectively, has a substantially circular cylindrical surface. The inner diameter of the inner peripheral surface 3*a* is greater than the outer diameter of the guide protrusions 5 of the nozzle 2A. The inner diameter of the inner peripheral surface 3*n* is approximately the same as the outer diameter of the first ratchets 6A and the second ratchets 6B.

The cap body 3A can be attached to the nozzle 2A so as to cover the guide protrusions 5 and the pouring outlet p1 in the nozzle 2A.

As shown in FIG. 1, a plurality of ribs 3*d* protrude from an outer peripheral surface 3*c* of the cap body 3A, other than part of the outer peripheral surface 3*c* in the Y-axis direction. The ribs 3*d* radially protrude with the central axis O as the center when viewed in the Z-axis direction. The ribs 3*d* configures an uneven portion that prevents fingers of the user from slipping during attachment/detachment of the cap 3.

The envelope surface in which the ends of the ribs 3*d* in the protruding direction thereof are linked together provides the outermost shape of the cap body 3A. Hereinafter, the outermost shape of the cap body 3A is simply referred to as the outer shape of the cap body 3A as long as there is no possibility of misunderstanding.

The outer shape of the cap body 3A is an ellipse whose major axis direction is parallel to the X-axis direction in plan view. The major axis of the outer shape of the cap body 3A is d1, and the minor axis thereof is d2 (however, d2<d1).

Therefore, the user can easier hold the cap body 3A by putting the fingers on the ends in the minor axis direction of the cap body 3A and rotating the cap body 3A than a case where the user holds the cap body 3A in the major axis direction and rotates it.

The ribs 3*d* extend in the axial direction, and the protrusion amounts thereof in the radial direction from the outer peripheral surface 3*c* are different. That is, the outer peripheral surface 3*c* of the cap body 3A is provided with the plurality of ribs 3*d* that extend in the axial direction and have different protrusion amounts in the radial direction, so that the outer shape of the cap body 3A is formed in an elliptical shape when viewed in the axial direction. The phrase "the outer shape of the cap body 3A is formed in an elliptical shape when viewed in the axial direction" denotes that an imaginary line L (refer to FIG. 7) connecting the outer ends in the radial direction of the ribs 3*d* to each other forms an elliptical shape. The "elliptical shape" of this embodiment may include an oval shape. The outer peripheral surface 3*c* of the cap body 3A includes a rib-forming area. R1 provided with the plurality of ribs 3*d* and a rib-less area R2 provided with no ribs. In other words, the protrusion amount in the radial direction of ribs in the rib-less area R2 is 0. The rib-less area R2 is arranged at each of two positions of the outer peripheral surface 3*c* with the central axis O interposed between the two positions.

In detail, the outer peripheral surface 3*c* of the cap body 3A of this embodiment includes a first outer peripheral surface 3*s* positioned on the top side thereof (close to the top) and a second outer peripheral surface 3*t* positioned on the base end side thereof, and the outer diameter of the first outer peripheral surface 3*s* is less than that of the second outer peripheral surface 3*t*. The length in the axial direction of the second outer peripheral surface 3*t* is about twice that of the first outer peripheral surface 3*s*, but this ratio may be appropriately adjusted. The rib-less area R2 of this embodiment is provided only on the second outer peripheral surface 3*t*. That is, part of the second outer peripheral surface 3*t* with which the minor axis of the above elliptical shape intersects when viewed in the axial direction is the rib-less area R2 having no ribs. The first outer peripheral surface 3*s* is provided with a plurality of ribs 3*d* on the entire circumference.

The present invention is not limited to such a configuration, the outer diameter of the outer peripheral surface 3*c* may be substantially constant in the axial direction, and the rib-less area R2 may be provided on the entire area in the axial direction of the outer peripheral surface 3*c*. The rib-less area R2 may not be provided on the outer peripheral surface 3*c*, and the cap body 3A may be formed in an elliptical shape when viewed in the axial direction only by the ribs 3*d* having different protrusion amounts in the radial direction.

As shown in FIG. 3, the end on a trailing side of the cap body 3A in the Z-axis positive direction is closed by a top surface portion 3*e* concaved in the Z-axis negative direction. A seal body 3*f* protrudes in the Z-axis negative direction from the inner surface of the top surface portion 3*c*.

The seal body 3*f* is a cylindrical protrusion that blocks the pouring outlet p1 of the spout 2 when the cap 3 is attached. In this embodiment, the seal body 3*f* has a cylindrical shape that is detachably fitted into the pouring outlet p1. The outer peripheral portion of the end of the seal body 3*f* is provided with a taper in order to facilitate insertion of the seal body 3*f* into the pouring outlet p1.

The end (that is, base end) on a trailing side of the cap body 3A in the Z-axis negative direction is provided with a flange 3*g* protruding outward in the radial direction from the outer peripheral surface 3*c*. The end surface 3*j* on a trailing side in the Z-axis negative direction of the cap body 3A slightly further protrudes downward or inward in the radial direction than the end surface on a trailing side in the Z-axis negative direction of the flange 3*g*.

The end surface on a trailing side in the Z-axis negative direction of the flange 3*g* is connected with the tamper band 3B through a connection piece 3*h* (weak portion). The connection piece 3*h* is a thin piece extending in a semicircular shape in plan view along the flange 3*g*. The connection piece 3*h* is the weak portion that can be broken by an external force received when the cap 3 is rotated as described later.

Flaps 7 (first inner protrusion) and stoppers 8 (second inner protrusion) protrude inward in the radial direction from the inner peripheral surface 3*a* of the cap body 3A, and the stopper 8 is formed so as to be adjacent to the flap 7 in the vicinity of the flap 7 in the circumferential direction. The stopper 8 is arranged to be close to the flap 7 in the circumferential direction of the inner peripheral surface 3*a* of the cap body 3A. Each of the numbers of the flaps 7 and the stoppers 8 is not particularly limited as long as each of the numbers is 1 or more. Hereinafter, an example where each of the numbers of the flaps 7 and the stoppers 8 is two will be described.

FIG. 7 shows a cross-sectional view taken along line A-A in FIG. 2. As shown in FIG. 7, in a state where the cap 3 is unopened, the major axis direction of the cap 3 is parallel to the Y-axis direction.

The two flaps 7 have an equal shape. The two stoppers 8 also have an equal shape. The flaps 7 are provided in a positional relationship of 180° rotational symmetry with the central axis O as the axis of symmetry, and the stoppers 8 are provided in a positional relationship of 180° rotational symmetry with the central axis O as the axis of symmetry.

The flaps 7 are arranged at positions facing each other in the Y-axis direction. Therefore, in a state where the cap 3 is unopened, each flap 7 overlaps one guide protrusion 5 when viewed in the Z-axis negative direction.

In a state where the cap 3 is unopened, each stopper 8 is arranged at a position fitted into the fitting gap formed between the engagement protrusion 6 and the inclined end surface 5*d*.

The flap 7 and the stopper 8 that are close to each other in the circumferential direction are provided in a range in the circumferential direction that can move in the axial direction along the second guide surface 2*d* between the guide protrusions 5. For example, in this embodiment, since the formation range of each guide protrusion 5 has a central angle with respect to the central axis O that is slightly less than 90°, the flap 7 and the stopper 8 that are close to each other in the circumferential direction are provided in a range whose central angle with respect to the central axis O is 90° or less.

As shown in FIG. 6, the flap 7 is a protrusion piece that diagonally extends in the Z-axis positive direction as going from the inner edge of the end surface 3*j* inward in the radial direction. The flap 7 has flexibility by being formed in a piece shape. Since the connection portion of the flap 7 with the end surface 3*j* has a function of a resin hinge, elastic displacement of the flap 7 in the radial direction is easily performed.

As shown in FIG. 8, the center of the flap 7 in the circumferential direction is provided with a slit 7*a*. Therefore, the flap 7 has higher flexibility than a case where the slit 7*a* is not provided.

The height from the end surface 3*j* to the edge 7*b* on a trailing side of the flap 7 in the Z-axis positive direction is approximately equal to the gap between the plate-shaped portion 2*b* of the nozzle 2A and the lower surface 5*a* of the guide protrusion 5. In this embodiment, since the lower surface 5*a* slightly inclines, the edge 7*b* also inclines in the circumferential direction similar to the lower surface 5*a*. For example, in the example shown in FIG. 8, the edge 7*b* has an inclination that slightly lowers from a first end F1 (on left side in the diagram) toward a second end F2 (on right side in the diagram).

The shape of the cap 3 is not particularly limited as long as the distance from the central axis O to the edge 7*b* is a size such that the flap 7 can be locked on the lower surface 5*a* of the guide protrusion 5 when the cap body 3A is attached to the nozzle 2A. For example, the distance from the central axis O to the edge 7*b* may be not less than the radius of the outer peripheral surface 2*a* and not greater than the radius of the side surface 5*c* of the guide protrusion 5. In this case, the distance from the central axis O to the edge 7*b* is preferably closer to the radius of the outer peripheral surface 2*a*. However, depending on the flexibility of the flap 7, the distance from the central axis O to the edge 7*b* may be less than the radius of the outer peripheral surface 2*a*.

The length of each flap 7 in the circumferential direction is set to a length such that the flap 7 can move in the axial direction on the second guide surface 2*d* and such that a pulling-out-proof strength required when the flap 7 is locked on the lower surface 5*a* of the guide protrusion 5 as described later is obtained. Therefore, the length in the circumferential direction of the flap 7 is determined in an appropriate length according to the length in the circumferential direction of the second guide surface 2*d*. For example, in this embodiment, the central angle of each flap 7 with respect to the central axis O may be 45° or more and 90° or less.

As shown in FIG. 8, the stopper 8 is a ridge that protrudes from the inner peripheral surface 3*a* inward in the radial direction and extends in the Z-axis direction. The position in the Z-axis direction of a lower end surface 8*a* that is the end surface on a trailing side of the stopper 8 in the Z-axis negative direction is approximately the same as the position in the Z-axis direction of the first end F1 in the edge 7*b* of the flap 7. However, when viewed in the Y-axis direction, the stopper 8 is adjacent to the first end F1 of the flap 7 in the circumferential direction, if the difference in height therebetween in the Z-axis direction is not taken into account.

As shown in FIG. 7, a tip portion of the stopper 8 in the radial direction has a mountain-shaped cross-section. A tip 8*b* of each stopper 8 in the radial direction is movable in the circumferential direction along the second guide surface 2*d* when the cap 3 is rotated around the central axis O. Therefore, the distance between each tip 8*b* and the central axis O is equal to or greater than the radius of the outer peripheral surface 2*a* of the nozzle 2A. The distance between each tip 8*b* and the central axis O is less than the radius of the side surface 5*c* of each guide protrusion 5 and is less than the distance from the central axis O to the top (the outer end in the radial direction) of each engagement protrusion 6. In this embodiment, as an example, the distance between each tip 8*b* and the central axis O is equal to the radius of the outer peripheral surface 2*a*.

The tip portion on a radially inner side of the stopper 8 is formed of a first slope 8*c* and a second slope 8*d*. The first slope 8*c* is provided on a close side of the tip portion to the first end F1 of the flap 7. The second slope 8*d* is provided on a reverse side of the tip portion to the first slope 8*c* in the circumferential direction.

The tip portion of the stopper 8 is formed in a shape that can be detachably fitted in the circumferential direction into a groove formed between the engagement protrusion 6 and the inclined end surface 5*d*.

In this embodiment, the first slope 8*c* has approximately the same inclination and the same width of the inclined surface as those of the inclined end surface 5*d*. Therefore, when the cap 3 is rotated in the clockwise direction shown in FIG. 7, the cap 3 cannot rotate beyond a position where the first slope 8*c* and the inclined end surface 5*d* contact each other.

On the other hand, the tip portion of the stopper 8 in the radial direction can get over the engagement protrusion 6 with a small rotational force even if the tip portion comes into contact with the engagement protrusion 6 in either of the clockwise direction and the counterclockwise direction shown in the diagram. The protrusion amounts of the stopper 8 and the engagement protrusion 6 in the radial direction are appropriately set, whereby the rotational force required when the tip portion gets over the engagement protrusion 6 is adjusted. The rotational force when the tip 8*b* of the stopper 8 gets over the engagement protrusion 6 is set to magnitude such that the user feels a moderate click when the tip portion of the stopper 8 is fitted into the groove between the engagement protrusion 6 and the inclined end surface 5*d* and when the tip portion of the stopper 8 moves out of the groove. For example, the height difference by which the tip 8*b* of the stopper 8 gets over the engagement protrusion 6 may be 0.05 mm or more and 1.0 mm or less in order to obtain a moderate click feeling. The height difference is a difference between a distance D1 from the central axis O to the outer end in the radial direction of the engagement protrusion 6 and a distance D2 from the central axis O to the tip 8*b* that is the inner end in the radial direction of the stopper 8. If the height difference is 0.05 mm or more, a moderate click feeling by the stopper 8 getting over the engagement protrusion 6 can be conveyed to the user when the cap 3 is rotated to open and close the nozzle 2A. If the height difference is 1.0 mm or less, the stopper 8 can appropriately get over the engagement protrusion 6 when the cap 3 is rotated to open and close the nozzle 2A. In other words, if D1/D2 is 1.01 or more and 1.2 or less, the above two effects can be obtained.

As shown in FIG. 1, the tamper band 3B is provided in order to make a mouth plug portion S configured of the cap 3 and the nozzle 2A have a tamper evidence structure.

As shown in FIG. 3, the tamper band 3B is formed in an annular shape having an outer diameter equivalent to that of the flange 3*g*.

The tamper band 3B includes a first band piece 3C and a second band piece 3D. The band width (width in the Z-axis direction) of each of the first band piece 3C and the second band piece 3D is a size that can laterally cover the plate-shaped portion 2*b*, the first ratchet 6A, and the second ratchet 6B of the nozzle 2A in a state where the cap 3 is attached to the nozzle 2A.

As shown in FIG. 5, the first band piece 3C and the second band piece 3D have semicircular shapes that face each other in the X-axis direction in plan view. The first band piece 3C is arranged on a trailing side of the cap 3 in the X-axis positive direction, and the second band piece 3D is arranged on a trailing side of the cap 3 in the X-axis negative direction. Two ends in the circumferential direction of the first band piece 3C and two ends in the circumferential direction of the second band piece 3D are connected to each other in the circumferential direction through linking pieces 3*i* (weak portion) having a width less than the band width. As shown in FIG. 3, the linking piece 3*i* links the ends on trailing sides of the first band piece 3C and the second band piece 3D in the Z-axis negative direction to each other. Therefore, as shown in FIG. 8, a slit extending in the Z-axis direction and penetrating the tamper band 3B in the radial direction is formed between the linking piece 3*i* and the flange 3*g*.

The ends on trailing sides of the first band piece 3C and the second band piece 3D in the Z-axis positive direction are connected to the flange 3*g* through the connection piece 3*h* described above.

As shown in FIG. 8, the end on a trailing side of the first band piece 3C in the Y-axis negative direction is fixed to the flange 3*g* through a fixed connection portion 3*k* that connects the flange 3*g* and the first band piece 3C with a high strength. The fixed connection portion 3*k* faces the connection piece 3*h* in the circumferential direction with a slit 3*m* interposed therebetween, and the slit 3*m* is provided on a trailing side in the Y-axis negative direction.

As shown in FIG. 3, a similar fixed connection portion 3*k* is formed at the end on a trailing side of the second band piece 3D in the Y-axis positive direction. Although not shown in FIG. 3, a slit 3*m* similar to that of the first band piece 3C is formed on a trailing side of the fixed connection portion 3*k* in the X-axis negative direction in the second band piece 3D. The fixed connection portions 3*k* of the first band piece 3C and the second band piece 3D have shapes and arrangement positions of 180° rotational symmetry with respect to the central axis O, and the slits 3*m* of the first band piece 3C and the second band piece 3D have shapes and arrangement positions of 180° rotational symmetry with respect to the central axis O.

In FIG. 5, the cross-section of the tamper band 3B taken along line B-B in FIG. 2 is superimposed on the plan view of the nozzle 2A and the flange portion 2B.

As shown in FIG. 5, the inner diameter of the inner peripheral surface 3*n* of the tamper band 3B is equal to the outer diameter of the radially outermost portions of the first ratchets 6A in the plate-shaped portion 2*b*.

A first claw portion 9A protrudes inward in the radial direction from each of the end on a trailing side of the first band piece 3C in the Y-axis positive direction and the end on a trailing side of the second band piece 3D in the Y-axis negative direction. The plan view shape of the first claw portion 9A inclines and extends outward in the radial direction as going in the clockwise direction when the tamper band 3B is viewed in the Z-axis negative direction. The first claw portion 9A is a protrusion in which such a plan view shape extends in the Z-axis direction (refer to FIG. 3).

In this embodiment, the first claw portion 9A in the unopened state faces the first ratchet 6A in the circumferential direction with a gap.

A second claw portion 9B protrudes inward in the radial direction from each of a portion of the first band piece 3C closer to the first claw portion 9A than the center in the circumferential direction of the first band piece 3C and a portion of the second band piece 3D closer to the first claw portion 9A than the center in the circumferential direction of the second band piece 3D. The plan view shape of the second claw portion 9B is approximately the same as that of the first claw portion 9A. The second claw portion 9B is a protrusion in which such a plan view shape extends in the Z-axis direction (refer to FIG. 3).

In this embodiment, the second claw portion 9B in the unopened state faces the second ratchet 6B in the circumferential direction with a gap. However, in this embodiment, the gap between the second claw portion 9B and the second ratchet 6B is greater than the gap between the first claw portion 9A and the first ratchet 6A.

The protrusion amounts of the first claw portion 9A and the second claw portion 9B from the inner peripheral surface 3*n* are substantially equal to each other. The end surfaces on inner sides in the radial direction of the first claw portion 9A and the second claw portion 9B slidably contact the outer edge of the plate-shaped portion 2*b*.

The cap 3 is made of a resin material that allows the cap body 3A and the tamper band 3B to be manufactured by integral molding. For example, the cap 3 may be made of synthetic resin such as polypropylene and polyethylene, and the polyethylene includes high density polyethylene, low density polyethylene, linear low density polyethylene and the like.

The nozzle 2A and the cap 3 described above can be opened as described below.

Hereinafter, operations of the structure of the mouth plug portion S will be described focusing on an initial opening operation of the mouth plug portion S and an opening/closing operation thereof after the initial opening.

Figure 9:
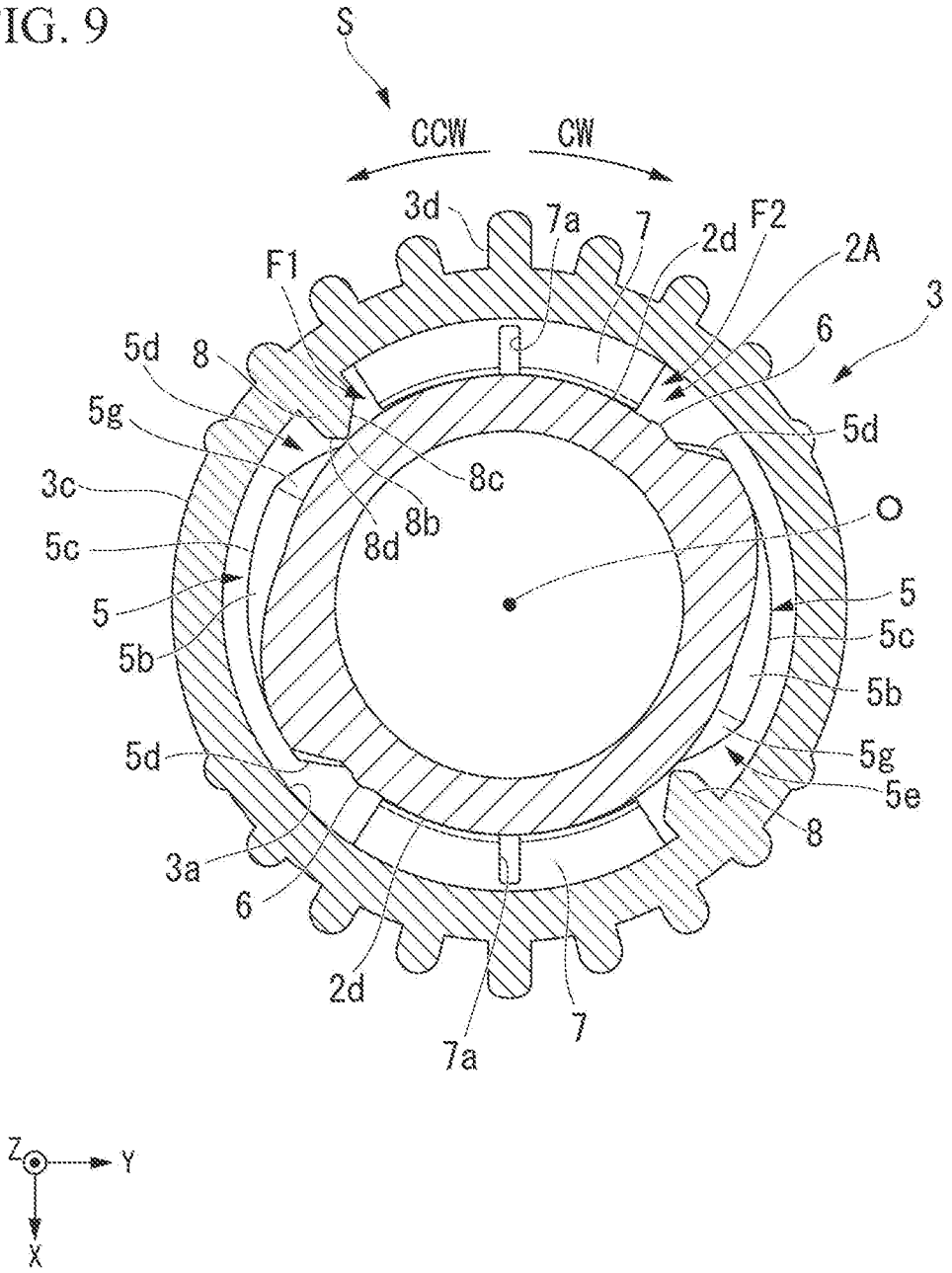
FIG. 9 is an operation explanatory diagram of opening operation of the mouth plug portion of the first embodiment of the present invention.
Figure 10:
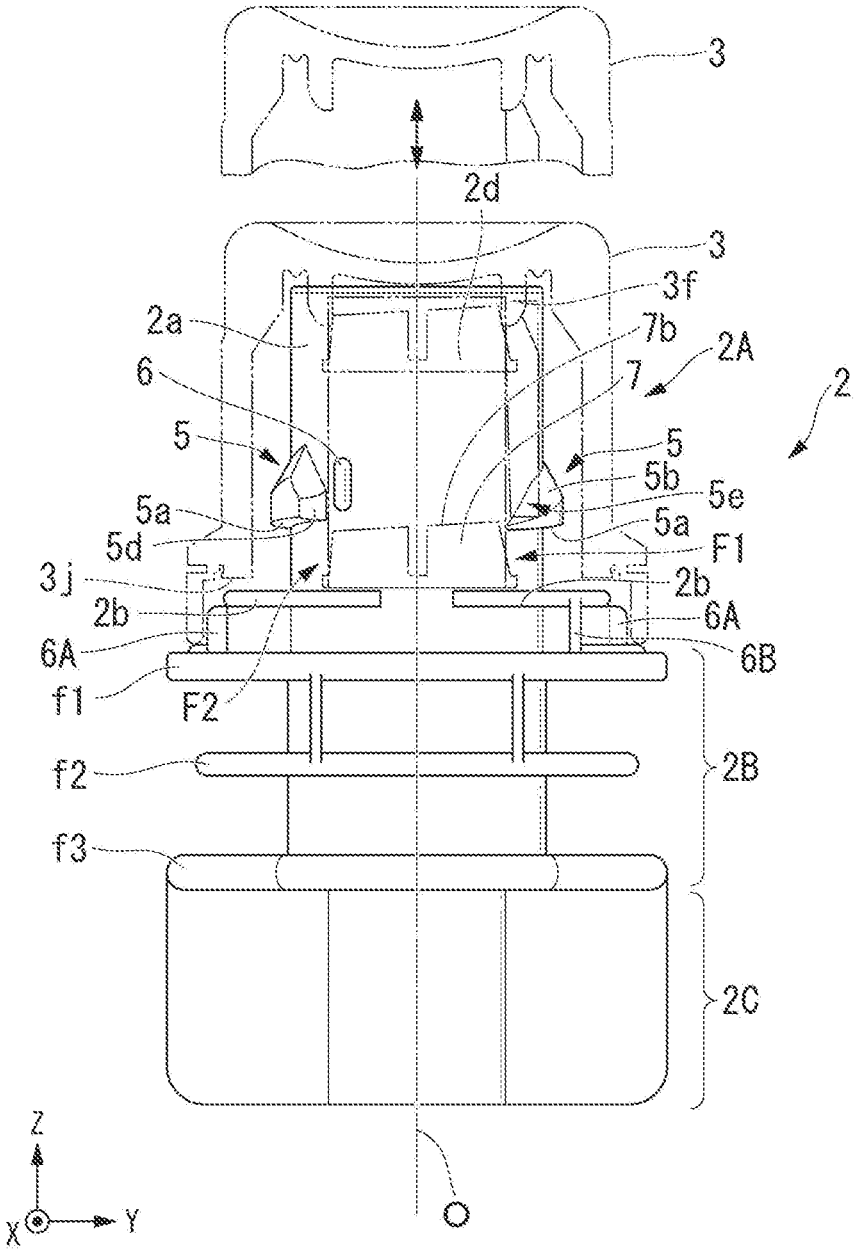
FIG. 10 is an operation explanatory diagram of the opening operation of the mouth plug portion of the first embodiment of the present invention.
Figure 11:
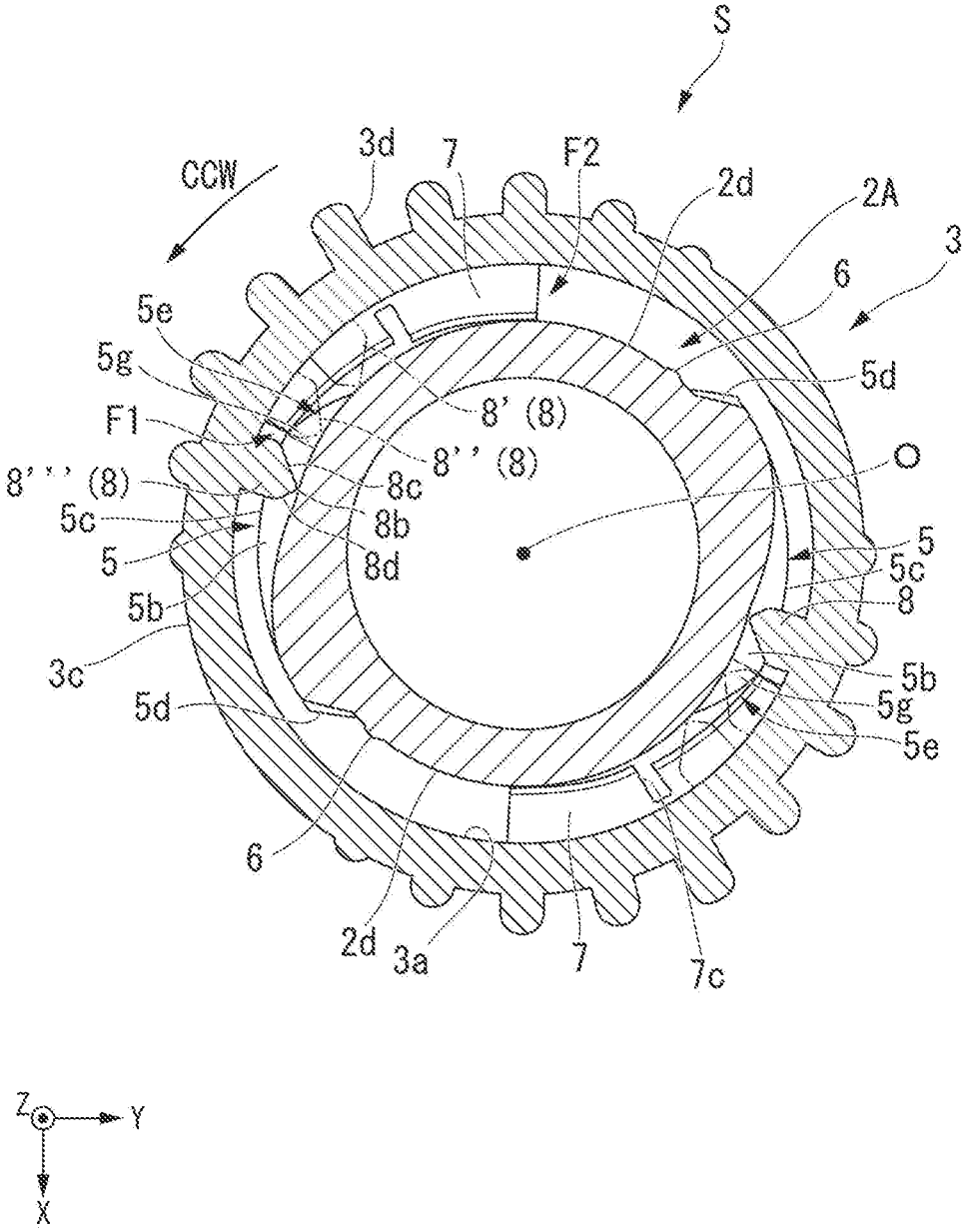
FIG. 11 is an operation explanatory diagram of the opening operation of the mouth plug portion of the first embodiment of the present invention.

FIGS. 9 to 11 are operation explanatory diagrams of opening operation of the mouth plug portion in the first embodiment of the present invention.

In the manufacturing process of the spout-attached pouch 1, after the spout 2 is fixed to the container body 4, the container body 4 is filled with contents from the pouring outlet p1 of the nozzle 2A. Thereafter, the cap 3 is attached to the nozzle 2A.

At this time, as shown in FIG. 2, the cap 3 is attached such that the major axis direction thereof is parallel to the Y-axis direction. At this time, the tamper band 3B is arranged so as to laterally cover the plate-shaped portion 2*b* (not shown). The end on a trailing side of the tamper band 3B in the Z-axis negative direction is adjacent to the first flange f1. The tamper band 3B faces the plate-shaped portion 2*b* from the outside in the radial direction.

In such a positional relationship, the flap 7 is positioned between the plate-shaped portion 2*b* and the guide protrusion 5 in the Z-axis direction. The edge 7*b* of the flap 7 is locked on the lower surface 5*a* of the guide protrusion 5. Therefore, in the unopened state where the cap 3 is attached, the user cannot pull out the cap 3 from the nozzle 2A in the Z-axis positive direction.

The unopened state is formed by pushing the cap 3 toward the nozzle 2A in a state where the major axis direction of the cap 3 is brought in parallel to the Y-axis direction.

First, the cap 3 is arranged above the nozzle 2A in a state where the cap 3 is coaxial with the central axis O. The major axis direction of the cap 3 is brought in parallel to the Y-axis direction. At this time, in plan view, as shown in FIG. 7, each stopper 8 is at a position that can be fitted into the groove between the engagement protrusion 6 and the inclined end surface 5*d*. The flap 7 and the guide protrusion 5 are in a positional relationship in which they overlap each other in plan view.

When the cap 3 is pushed onto the nozzle 2A, the flap 7 contacts the upper surface 5*b* of the guide protrusion 5. The flap 7 is bent toward the inner peripheral surface 3*a* by being pushed outward in the radial direction by the guide protrusion 5. Thereby, the resistance from the guide protrusion 5 decreases, so that the flap 7 gets over the guide protrusion 5. Therefore, the cap 3 can further move in the Z-axis negative direction.

At this time, as shown in FIG. 5, the first claw portion 9A and the second claw portion 9B are in positional relationships away from the first ratchet 6A and the second ratchet 6B of the nozzle 2A in the circumferential direction, respectively. Therefore, the first claw portion 9A and the second claw portion 9B do not come into contact with the first ratchet 6A and the second ratchet 6B, respectively, and thus the movement of the cap 3 is not hindered.

When each flap 7 gets over each guide protrusion 5, the pressing force applied to the flap 7 outward in the radial direction disappears. The flap 7 protrudes inward in the radial direction due to the elastic restoring force of the flap 7. Thereby, as shown by the dashed-double dotted line in FIG. 3, the edge 7*b* of the flap 7 is locked on the lower surface 5*a* of the guide protrusion 5.

In this way, the cap 3 is pushed in the Z-axis negative direction and thus is closed.

In the above, an example where the cap 3 is gradually pushed has been described, but like so-called striking-capping, the closing may be performed by applying an impact force to the cap 3 in the axial direction.

In this case, the position in the circumferential direction of the cap 3 may shift due to the impact. However, the first inclined surface 5*f* is adjacent to a trailing side of the inclined end surface 5*d* in the Z-axis positive direction. Therefore, even if the cap 3 slightly shifts in the clockwise direction when viewed in the Z-axis negative direction, the stopper 8 slides along the first inclined surface 5*f*, so that the stopper 8 is fitted into the groove between the engagement protrusion 6 and the inclined end surface 5*d*.

For example, in a case where the cap 3 is closed by an automatic machine such as a robot, after the cap 3 is pushed, if necessary, an adjustment may be performed in which the cap 3 is moved in the circumferential direction such that the tip portion of the stopper 8 is fitted into the groove between the engagement protrusion 6 and the inclined end surface 5*d*.

In such an unopened state, as shown by the dashed-double dotted line in FIG. 3, the seal body 3*f* is fitted into the pouring outlet p1. Therefore, the pouring outlet p1 is closed by the seal body 3*f*.

In order to open the cap 3 from such an unopened state, the user rotates the cap 3 in the counterclockwise direction shown in FIG. 7 (refer to arrow CCW). Even if the user tries to rotate the cap 3 in the clockwise direction shown in the diagram, the first slope 8*c* of the stopper 8 is locked on the inclined end surface 5*d*, so that the resistance force in the circumferential direction increases. Therefore, the user can easily become aware that the cap cannot be opened even if rotating the cap in the clockwise direction.

The user can rotate the cap 3 with a smaller rotation force by rotating the cap 3 in a state of putting fingers on the ends in the minor axis direction of the cap 3. Particularly, in this embodiment, the contact area of the user's fingers with respect to the cap 3 increases by putting the fingers on the ends in the minor axis direction of the cap 3, so that the user can easily hold the cap 3.

When the cap 3 is rotated in the counterclockwise direction shown in the diagram, the stoppers 8 and the flaps 7 provided in the cap body 3A also rotate counterclockwise. For example, the stopper 8 gets over the engagement protrusion 6 and moves into the area of the second guide surface 2*d*. The user can become aware that opening the cap has started by a click feeling when the stopper 8 gets over the engagement protrusion 6.

On the other hand, since the flap 7 moves along the smooth lower surface 5*a*, there is almost no resistance caused by the flap 7.

When the cap 3 is rotated in the counterclockwise direction shown in the diagram, the tamper band 3B also rotates counterclockwise in FIG. 5 (refer to arrow CCW). Therefore, in the example shown in FIG. 5, the first claw portions 9A come into contact with the first ratchets 6A in the circumferential direction at approximately the same time as the start of rotation. Similarly, the second claw portions 9B come into contact with the second ratchets 6B in the circumferential direction. Both of these contacts may simultaneously occur, or these contacts may individually occur. In the example shown in FIG. 5, both contacts occur at approximately the same time.

Since the first claw portion 9A and the first ratchet 6A have slopes that engage with each other, a force of pressing the first claw portion 9A and the first ratchet 6A on each other in the circumferential direction acts therebetween. When the user continues counterclockwise rotation, the first claw portion 9A gets over the first ratchet 6A. When the first claw portion 9A gets over the first ratchet 6A, a pressing force outward in the radial direction acts on the tamper band 3B from the first claw portion 9A.

Similarly, since the second claw portion 9B and the second ratchet 6B have slopes that engage with each other, when the second claw portion 9B gets over the second ratchet 6B, a pressing force outward in the radial direction acts on the tamper band 3B from the second claw portion 9B.

Therefore, each of the linking piece 3*i* and the connection piece 3*h*, which are the weak portions, is broken.

In this way, while the cap 3 is rotated about 45° from the unopened state (or a state where the stopper 8 is positioned at the fitting gap between the first end e1 and the engagement protrusion 6), the linking piece 3*i* and the connection piece 3*h* are broken, so that the first band piece 3C and the second band piece 3D are separated from each other. Thereby, the rotation resistance to the cap 3 decreases. Furthermore, thereby, it is possible to visually confirm that the cap 3 has been rotated.

When the cap 3 is rotated about 90°, as shown in FIGS. 9 and 10, each flap 7 moves out of the guide protrusion 5 and moves to a position facing the second guide surface 2*d*. FIG. 9 is a cross-sectional view at the same position as FIG. 7, which is a cross-sectional view taken along line A-A in FIG. 2.

In this state, the user can pull out the cap 3 in the Z-axis positive direction. While the user moves the cap 3 in the Z-axis positive direction, the flap 7 is guided along the second guide surface 2*d*. The cap 3 is pulled out of the nozzle 2A with almost no resistance. In this state, the stopper 8 is also guided along the second guide surface 2*d*.

Thereby, the mouth plug portion S is opened. In this embodiment, the cap 3 can be opened by being rotated about 90°, so that the cap can be opened more quickly than a case where the cap and the nozzle are screwed together.

However, depending on the user, it is conceivable that the user further rotates the cap 3 counterclockwise without recognizing that the cap has been opened. Even in such a case, in this embodiment, the cap 3 is reliably pulled out as described below.

When the cap 3 is further rotated in the counterclockwise direction shown in the diagram from the state shown in FIG. 9, the stopper 8 and the flap 7 provided in the cap body 3A also rotate counterclockwise. For example, the stopper 8 moves from a position where a stopper 8' is shown through a position where a stopper 8" is shown to a position where a stopper 8'" is shown, the stoppers 8' and 8" are shown by the dashed-double dotted lines in FIG. 11, and the stopper 8'" is shown by the solid line in FIG. 11.

For example, the stopper 8' has reached the end of the inclined portion 5*e* (also refer to FIG. 4). The stopper 8" is running up on the second inclined surface 5*g*. At this time, the first end F1 of the flap 7 comes into contact with the inclined portion 5*e* in the radial direction. Therefore, at the first end F1, the edge 7*b* of the flap 7 can move in the circumferential direction and the Z-axis positive direction along the inclined portion 5*e* positioned on a trailing side of the lower surface 5*a* in the Z-axis positive direction. As the rotation of the cap 3 progresses, the flap 7 moves along the inclined portion 5*e* and is pushed outward in the radial direction. Since the flap 7 has flexibility, the flap 7 is bent and deformed toward the inner peripheral surface 3*a*. Therefore, the edge 7*b* of the flap 7 is sandwiched between the guide protrusion 5 and the inner peripheral surface 3*a* without being locked on the lower surface 5*a*.

In this way, the stopper 8'" runs up on the upper surface 5*b* (also refer to FIG. 4).

When the cap 3 is further rotated counterclockwise, the stopper 8 moves in the Z-axis positive direction along the second inclined surface 5*g* and the upper surface 5*b* as shown by the dashed-double dotted line in FIG. 4. As a result, an external force that pushes out the cap 3 in the Z-axis positive direction relative to the nozzle 2A is applied to the cap 3 from the guide protrusion 5.

In this way, in this embodiment, the user rotates the cap 3 by about 90° or more counterclockwise to open the mouth plug portion S. When the user rotates the cap 3 by greater than 90°, the cap 3 is automatically pushed up in the Z-axis positive direction, so that the user can become aware that the cap has been opened. Therefore, most of the users can open the mouth plug portion S by rotating the cap by 90° or slightly greater than 90°.

Consequently, the user can much easier open the cap than a case where the cap is screwed on the nozzle.

In this embodiment, the first band piece 3C and the second band piece 3D are fixed to the cap body 3A through the fixed connection portions 3*k*. The fixed connection portion 3*k* is separated from the connection piece 3*h* with the slit 3*m* interposed therebetween. As a result, even if the entire connection piece 3*h* is cut, cracks occurring in the connection piece 3*h* do not reach the fixed connection portion 3*k*, so that the fixed connection portion 3*k* is not cut through the opening operation.

Therefore, the first band piece 3C and the second band piece 3D are connected to the flange 3*g* through the fixed connection portions 3*k* even after opening the cap, and are pulled out from the nozzle 2A together with the cap body 3A. Cut pieces including the first band piece 3C and the second band piece 3D are integrated in the cap 3 without remaining in the nozzle 2A.

Therefore, when opening the cap, cut pieces that are cut and separated from the cap body 3A and become trash are not produced.

For example, even if the user drinks the contents in a state where the user's mouth contacts the nozzle 2A, the cut pieces do not remain in the nozzle 2A, the user's mouth does not touch the cut pieces, and thus the feeling of use for the user is improved.

Next, the opening/closing operation after the initial opening will be described.

After the initial opening, in order that the user closes the nozzle 2A, the user may perform an operation similar to a case where the mouth plug portion S closes the spout-attached pouch 1 after the contents have been filled therein as described above.

However, the user may close the cap by performing the above-described opening operation in reverse order.

That is, the cap 3 is moved in the Z-axis negative direction in a state where the major axis direction of the cap 3 is brought in parallel to the X-axis direction (the minor axis direction thereof is brought in parallel to the Y-axis direction), as shown by the dashed-double dotted line in FIG. 10, whereby the cap 3 is attached to the nozzle 2A. In such an attitude of the cap 3, since the flap 7 and the stopper 8 are positioned within the range of the second guide surface 2*d* of the nozzle 2A, the flap 7 is guided along the second guide surface 2*d*, and the cap 3 is smoothly attached to the nozzle 2A. Since the tamper band 3B is broken after the initial opening, the tamper band 3B does not make insertion resistance at the time of attachment.

In the cap body 3A, when the end surface 3*j* is inserted to an insertion limit position close to the plate-shaped portion 2*b* as shown by the dashed-double dotted line in the diagram, the seal body 3*f* is fitted into the pouring outlet p1.

Thereafter, the user rotates the cap 3 in the clockwise direction in FIG. 9 (refer to arrow CW). In FIG. 10, the flap 7 shown by the dashed-double dotted line on a trailing side in the X-axis positive direction moves toward the left side of the diagram. The flap 7 enters a space between the lower surface 5*a* of the guide protrusion 5 and the plate-shaped portion 2*b*. The edge 7*b* of the flap 7 moves along the lower surface 5*a* while sliding on the lower surface 5*a*. At this time, the seal body 3*f* is closely fitted into the opening of the nozzle 2A, and the movement of the cap in the Z-axis negative direction is restricted, so that the edge 7*b* is pressed against the lower surface 5*a*. Therefore, a gap is formed between the end on a trailing side of the flap 7 in the Z-axis negative direction and the plate-shaped portion 2*b*.

During the rotation of the cap 3, since the tamper band 3B has been broken, rotation resistance does not occur by the first claw portion 9A and the second claw portion 9B coming into contact with the first ratchet 6A and the second ratchet 6B.

Even if the first claw portion 9A and the second claw portion 9B come into contact with the first ratchet 6A and the second ratchet 6B, respectively, the claw portions 9A and 9B can easily get over the ratchets 6A and 6B because the inclination directions thereof are the same.

As shown in FIG. 7, when the cap 3 is rotated about 90°, each flap 7 moves to an area substantially overlapping the guide protrusion 5 when viewed in the Z-axis negative direction. Therefore, the edge 7*b* of the flap 7 is locked on a trailing side of the guide protrusion 5 in the Z-axis negative direction. As a result, the cap 3 is prevented from being pulled out in the Z-axis direction. In this way, the nozzle 2A is closed by the cap 3.

In such a closing operation, while the cap 3 rotates, the stopper 8 also moves clockwise along the outer peripheral surface 2*a*. As shown by the dashed-double dotted line in FIG. 7, when the stopper 8 reaches the position of the engagement protrusion 6, the stopper 8 is pushed outward in the radial direction when getting over the engagement protrusion 6, so that slight resistance occurs. As shown by the solid line, when the stopper 8 gets over the engagement protrusion 6, the stopper 8 is fitted into the V-shaped groove between the engagement protrusion 6 and the inclined end surface 5*d*. At this time, since the rotational resistance sharply decreases, the user feels a click.

From this state, when the user attempts to further rotate the cap in the clockwise direction in the diagram, the first slope 8*c* is locked on the inclined end surface 5*d*, so that the resistance force in the circumferential direction increases. Therefore, the user can become aware that the rotation has reached the limit thereof.

The closing operation by rotating the cap 3 clockwise is not limited to an operation that is started from a state where the major axis direction of the cap 3 is brought in parallel to the X-axis direction, but it can also be applied to a closing operation that is started from a state other than a state where the major axis direction of the cap 3 is brought in parallel to the Y-axis direction. In that case, part of the flap 7 gets over the guide protrusion 5, the other part of the flap 7 and the stopper 8 are guided along the second guide surface 2*d* of the nozzle 2A, and the cap 3 is attached to the nozzle 2A. Thereafter, by rotating the cap clockwise until the major axis direction of the cap 3 is parallel to the Y-axis direction, the edge 7*b* of the flap 7 is locked on a trailing side of the guide protrusion 5 in the Z-axis negative direction, and the stopper 8 is fitted into the V-shaped groove between the engagement protrusion 6 and the inclined end surface 5*d*.

In this way, when the major axis direction of the cap 3 is brought in parallel to the Y-axis direction, the closing operation is finished.

In the closing operation of this embodiment, the cap 3 is rotated from a state where the cap 3 protrudes in the X-axis direction by the major axis direction of the cap 3 being orthogonal to the extending direction of the upper seal 4*d* to a state where the protrusion amount of the cap 3 is reduced by the major axis direction of the cap 3 being parallel to the extending direction of the upper seal 4*d*. Therefore, it is easy to recognize whether or not the cap is closed by just looking at it, and it is possible to prevent the user from forgetting to close it.

The click feeling during rotation also makes it easy to inform the user whether or not the cap 3 has been moved to a predetermined position when the cap is closed, and thus it is easy to prevent an incomplete closed state.

When the user opens the cap from such a closed state, the user may rotate the cap 3 in the counterclockwise direction as shown in FIG. 9 similar to the initial opening.

As described above, the mouth plug portion S of this embodiment has a tamper evidence structure that can visually confirm that the cap 3 has been rotated because the tamper band 3B is cut by rotating the cap 3 including the tamper band 3B during opening.

According to the structure of the mouth plug portion S of this embodiment, since the structure of the mouth plug portion S includes the guide protrusion 5 of the nozzle 2A, and the engagement protrusion 6 and the flap 7 of the cap 3, an initial opening operation and an opening/closing operation after the initial opening become easy.

A structure of a mouth plug portion S of this embodiment includes: a tubular nozzle 2A whose top T is provided with a pouring outlet p1 (opening); and a cap 3 that is detachably fitted to an outer periphery and the top T of the nozzle 2A and closes the pouring outlet p1 when being attached to the nozzle 2A.

The nozzle 2A includes: a guide protrusion 5 provided partially in a circumferential direction of an outer peripheral surface 2*a* of the nozzle 2A at a position away from the top T in an axial direction and protruding outward in a radial direction, and ratchets 6A and 6B provided at positions further than the guide protrusion 5 in the axial direction with respect to the top T and protruding outward in the radial direction from the outer peripheral surface of the nozzle 2A.

The guide protrusion 5 includes: a lower surface 5*a* that locks the cap 3 such that the cap 3 is prevented from being pulled out, and an upper surface 5*b* spirally extending between the lower surface 5*a* and the top T.

The cap 3 includes: a cap body 3A configured to be attached to the nozzle 2A so as to cover the guide protrusion 5 and the pouring outlet p1, and a tamper band 3B connected to a base end side of the cap body 3A and formed into an annular shape that laterally covers the ratchets 6A and 6B when the cap body 3A is attached to the nozzle 2A, part of the tamper band 3B in the circumferential direction being provided with a linking piece 3*i* configured to be broken by an external force received from the ratchets 6A and 6B when the cap body 3A is rotated.

The cap body 3A includes: a flap 7 that protrudes inward in the radial direction from an inner peripheral surface 3*a* thereof and is configured to be locked on the lower surface 5*a* when the cap body 3A is attached to the nozzle 2A, and a stopper 8 that protrudes inward in the radial direction from the inner peripheral surface 3*a* and is provided so as to be movable along the upper surface 5*b* in a state where the flap 7 is not locked on the lower surface 5*a*.

The outer peripheral surface of the nozzle 2A is provided with a second guide surface 2*d* along which the flap 7 and the stopper 8 move in the axial direction during attachment/detachment of the cap 3.

The nozzle 2A further includes an engagement protrusion 6 forming a fitting gap between the engagement protrusion 6 and a first end e1 that is one of two ends of the guide protrusion 5 in the circumferential direction, the upper surface 5*b* at the first end e1 is closer to the top T than the other end of the two ends, and the fitting gap allows the stopper 8 of the cap body 3A to be removably fitted thereinto.

The flap 7 is formed of a protrusion piece extending diagonally inward in the radial direction from a base end of the cap body 3A.

A second end e2 is one of two ends of the guide protrusion 5 in the circumferential direction, the upper surface 5*b* at the second end e2 is further than the upper surface 5*b* at the other end of the two ends with respect to the top T, and the protrusion amount of the guide protrusion 5 outward in the radial direction at the second end e2 and in the vicinity of the second end e2 gradually increases from the second end e2 to the first end e1 on a distant side from the second end e2 in the circumferential direction.

The outer shape of the cap body 3A when viewed in the axial direction of the cap body 3A has a flat shape as a whole.

The outer shape of the cap body 3A when viewed in the axial direction is formed into an elliptical shape by an outer peripheral surface 3*c* of the cap body 3A being provided with a plurality of ribs 3*d* extending in the axial direction and having different protrusion amounts in the radial direction.

The outer peripheral surface 3*c* of the cap body 3A includes a first outer peripheral surface 3*s* on a top side in the axial direction and a second outer peripheral surface 3*t* on a base end side in the axial direction, the outer diameter of the first outer peripheral surface 3*s* is less than that of the second outer peripheral surface 3*t*, and part of the second outer peripheral surface 3*t* with which a minor axis of the elliptical shape intersects is a rib-less area R2 provided with no ribs.

The guide protrusion 5 includes a pair of guide protrusions 5 provided in the nozzle 2A. A pair of ratchets 6A and 6B are provided in the nozzle 2A. Each pair of the guide protrusions 5 and the ratchets 6A and 6B have 180° rotationally symmetry in the circumferential direction such that the second guide surface 2*d* is disposed therebetween.

The flap 7 and the stopper 8 of the cap body 3A are formed within a range less than or equal to the width of the second guide surface 2*d* in the circumferential direction of the nozzle 2A, the flap 7 includes a pair of flaps 7 provided in the cap body 3A, the stopper 8 includes a pair of stoppers 8 provided in the cap body 3A, and each pair of the flaps 7 and the stoppers 8 have 180° rotationally symmetry in the circumferential direction of the cap body 3A.

The nozzle 2A further includes an auxiliary protrusion 10, and the auxiliary protrusion 10 includes an inclined guide surface 10*a*, the inclined guide surface 10*a* extends from a position between the guide protrusion 5 and the ratchets 6A and 6B in the axial direction toward the second end e2 that is one of two ends of the guide protrusion 5 in the circumferential direction, the upper surface 5*b* at the second end e2 is further than the upper surface 5*b* at the other end of the two ends with respect to the top T, and the flap 7 is movable while being into contact with the inclined guide surface 10*a*.

A spout-attached pouch 1 of this embodiment includes the above-described structure of a mouth plug portion S.

Second Embodiment

Figure 12:
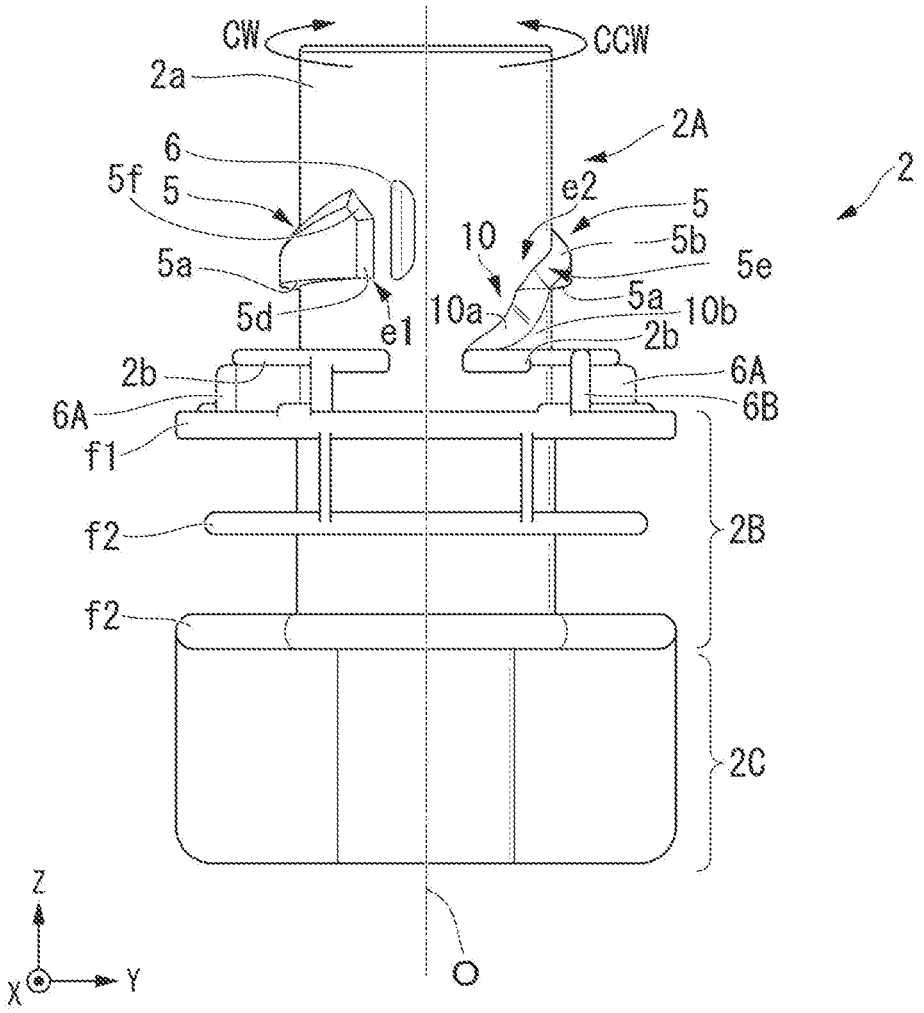
FIG. 12 is a schematic front view of a nozzle of a mouth plug portion of a second embodiment of the present invention.

Next, a second embodiment of the present invention will be described with reference to FIGS. 11 and 12. In this embodiment, components having equivalent configurations and functions to those of the above first embodiment are attached with the same reference signs as those of the first embodiment, and duplicate descriptions may be omitted. In FIGS. 11 and 12, the conduit portion 2D is omitted.

Figure 13:
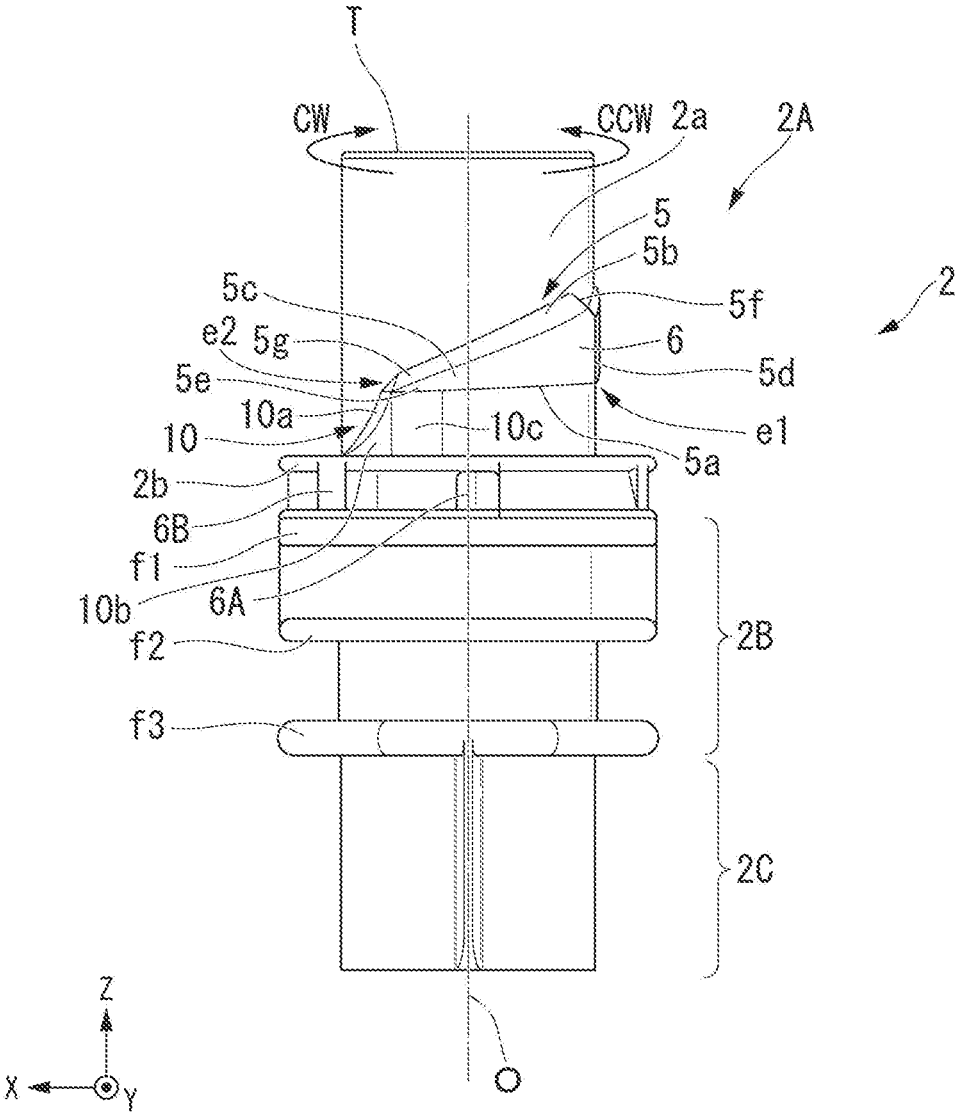
FIG. 13 is a schematic side view of the nozzle of the mouth plug portion of the second embodiment of the present invention.

As shown in FIGS. 12 and 13, the outer peripheral surface 2*a* of the nozzle 2A of this embodiment is provided with an auxiliary protrusion 10 between the guide protrusion 5 and the ratchets 6A and 6B in the axial direction, and the auxiliary protrusion 10 protrudes outward in the radial direction. The auxiliary protrusion 10 of this embodiment is provided between the guide protrusion 5 and the plate-shaped portion 2*b* in the axial direction. The auxiliary protrusion 10 is provided below the second end e2 of the guide protrusion 5. The auxiliary protrusion 10 of this embodiment is connected to the guide protrusion 5 and the plate-shaped portion 2*b*, but the present invention is not limited to this configuration, and a gap may be provided between the auxiliary protrusion 10 and the guide protrusion 5, and a gap may be provided between the auxiliary protrusion 10 and the plate-shaped portion 2*b*.

The auxiliary protrusion 10 includes an inclined guide surface 10*a*, the inclined guide surface 10*a* extends from a position between the guide protrusion 5 and the ratchets 6A and 6B in the axial direction toward the second end e2 (corresponding to the base end-side end of the present invention), the second end e2 is one of two ends of the guide protrusion 5 in the circumferential direction, the upper surface 5*b* at the second end e2 is further than the upper surface 5*b* at the other of the two ends with respect to the top T of the nozzle 2A, and the flap 7 is movable while contacting the inclined guide surface 10*a*. The inclined guide surface 10*a* of this embodiment extends from a position between the guide protrusion 5 and the plate-shaped portion 2*b* in the axial direction toward the second end e2 of the guide protrusion 5. The inclined guide surface 10*a* inclines toward the top T as going in the counterclockwise direction. The inclination angle of the inclined guide surface 10*a* with respect to a plane orthogonal to the central axis O is greater than the inclination angle of the upper surface 5*b* with respect to the plane. The inclined guide surface 10*a* of this embodiment is curved so as to be depressed downward, but may be curved so as to be bulge upward, and may extend in linear or in an S-shape. The inclined guide surface 10*a* of this embodiment is connected to the second end e2 of the guide protrusion 5, but the present invention is not limited to this configuration, and a gap may be provided between the inclined guide surface 10*a* and the second end e2. The size of the gap may be appropriately set within a range in which the flap 7 is not caught or dropped. The inclined guide surface 10*a* of this embodiment is connected to the upper surface of the plate-shaped portion 2*b*, but the present invention is not limited to this configuration, and a gap may be provided between the inclined guide surface 10*a* and the plate-shaped portion 2*b*. The width in the radial direction of the inclined guide surface 10*a* may be set within a range in which the edge 7*b* of the flap 7 can move while contacting the inclined guide surface 10*a*.

A side surface 10*b* of the auxiliary protrusion 10 is an outer surface in the radial direction of the auxiliary protrusion 10. The side surface 10*b* extends in the axial direction and the circumferential direction. An edge (edge on the right side in FIG. 13) on a trailing side of the side surface 10*b* in the counterclockwise direction extends in the axial direction.

An inclined surface 10*c* of the auxiliary protrusion 10 is positioned to be next to a trailing side of the side surface 10*b* in the counterclockwise direction and is connected to the above edge of the side surface 10*b*. The height in the radial direction of the inclined surface 10*c* gradually decreases in the counterclockwise direction. The inclined surface 10*c* extends in the axial direction and a tangential direction of the outer peripheral surface 2*a* of the nozzle 2A.

The height in the radial direction of the auxiliary protrusion 10 may be set to an extent in which the flap 7 can be prevented from getting over the auxiliary protrusion 10 when the flap 7 positioned at a gap between the guide protrusion 5 and the plate-shaped portion 2*b* moves clockwise.

The length in the circumferential direction of the guide protrusion 5 in this embodiment is greater than that of the guide protrusion 5 in the first embodiment. The position in the circumferential direction of the second end e2 in this embodiment is equivalent to the position in the circumferential direction of the second end e2 in the first embodiment, and the first end e1 in this embodiment is at a position shifted in the counterclockwise direction compared to that in the first embodiment. Since the inclination angle of the upper surface 5*b* with respect to a plane orthogonal to the central axis O is equivalent to that in the first embodiment, the length in the axial direction of the first end e1 in this embodiment is greater than that in the first embodiment, and the central angle of the guide protrusion 5 with respect to the central axis O is about 90° to 120°. As a result, the length in the axial direction of the inclined end surface 5*d* is also increased. In the above first embodiment, the area of the inclined end surface 5*d* is less than that of the first inclined surface 5*f* (refer to FIG. 3), but in this embodiment, the area of the inclined end surface 5*d* is greater than that of the first inclined surface 5*f*. Therefore, in this embodiment, it is possible to more reliably prevent the stopper 8 from getting over the inclined end surface 5*d* when the stopper 8 positioned between the inclined end surface 5*d* and the engagement protrusion 6 moves in the clockwise direction.

The length in the axial direction of the engagement protrusion 6 of this embodiment is greater than that of the engagement protrusion 6 of the first embodiment. Therefore, the click feeling when the stopper 8 gets over the engagement protrusion 6 can be increased and can be reliably transmitted to the user. The edge (edge on the right side in FIG. 12) on a leading side of the engagement protrusion 6 of this embodiment in the clockwise direction has a shape that bulges in an arc shape outward in the radial direction in plan view, and the edge (edge on the left side in FIG. 12) on a trailing side thereof in the clockwise direction has a shape sharply extending approximately in the radial direction. Therefore, the click feeling when the stopper 8 gets over the engagement protrusion 6 in the counterclockwise direction can be made to be greater than the click feeling when the stopper 8 gets over the engagement protrusion 6 in the clockwise direction. The configuration of the engagement protrusion 6 may be reversed in the circumferential direction.

Next, the function will be described when the cap 3 is rotated in the counterclockwise direction in order to open the nozzle 2A from a state where the cap 3 closes the nozzle 2A, that is, a state where the flap 7 is positioned between the guide protrusion 5 and the plate-shaped portion 2*b* and the stopper 8 is positioned in the fitting gap between the inclined end surface 5*d* and the engagement protrusion 6. In the following description, the tamper band 3B may not be broken or may be broken.

When the cap 3 is rotated in the counterclockwise direction from a state where the cap 3 is closing the nozzle 2A, that is, a state where the flap 7 is positioned in a gap between one guide protrusion 5 and the plate-shaped portion 2*b*, first, the stopper 8 gets over the engagement protrusion 6, then the edge 7*b* of the flap 7 comes into contact with the inclined guide surface 10*a* of the auxiliary protrusion 10, and the stopper 8 comes into contact with the second inclined surface 5*g* or the upper surface 5*b* of the guide protrusion 5. When the cap 3 is further rotated in the counterclockwise direction, the stopper 8 moves along the upper surface 5*b*, the flap 7 moves along the inclined guide surface 10*a*, and since the inclined guide surface 10*a* extends toward the second end e2 of the guide protrusion 5, the flap 7 can appropriately move from the inclined guide surface 10*a* to the upper surface 5*b* of the guide protrusion 5. Therefore, for example, it is possible to reliably prevent the flap 7 in moving counterclockwise from entering a gap between the plate-shaped portion 2*b* and another guide protrusion 5 different from the above one guide protrusion 5. When the flap 7 moves from the inclined guide surface 10*a* to the upper surface 5*b* of the guide protrusion 5, the stopper 8 may not be in contact with the upper surface 5*b*. Thereafter, the nozzle 2A is opened similarly to the first embodiment.

After performing the initial opening operation and breaking the tamper band 3B, when performing the closing operation again, the cap 3 is rotated clockwise in a state where the cap 3 covers the top T and the guide protrusions 5. After the stopper 8 has got over the engagement protrusion 6 in the clockwise direction, the stopper 8 and the flap 7 come into contact with the inclined end surface 5*d* and the inclined surface 10*c*, respectively, at substantially the same time. Therefore, even if the user tries to further rotate the cap 3 in the clockwise direction, this rotation can be reliably prevented.

Hereinbefore, the embodiments of the present invention have been described, but the present invention is not limited to the above embodiments. Additions, omissions, replacements, and other changes can be made for the configuration within the scope of the present invention.

The present invention is not limited by the above description, but only by the appended claims.

For example, in the description of the above embodiments, since the spout 2 includes the engagement protrusion 6, a fitting gap (groove) is formed between the inclined end surface 5*d* and the engagement protrusion 6, into which the tip portion of the stopper 8 is detachably fitted.

However, if the closed state can be easily maintained by the frictional force between the flap 7 and the lower surface 5*a*, the engagement protrusion 6 may be omitted. Even in this case, the user can easily recognize that the closing is finished when the first slope 8*c* of the stopper 8 comes into contact with the inclined end surface 5*d* of the guide protrusion 5 to stop the rotation.

In the description of the above embodiments, the first inner protrusion is configured of the flap 7 including the protrusion piece. However, the first inner protrusion is not limited to the protrusion piece. For example, when the cap body 3A itself is made of a flexible material, even if the first inner protrusion is not flexible, the same opening/closing operation as in the above embodiments can be performed. For example, when the cap 3 is rotated about 90° or more and the first inner protrusion is interposed between the guide protrusion 5 and the inner peripheral surface 3*a*, the cap body 3A is deformed outward in the radial direction, so that the opening operation can be performed similar to the above embodiments.

In the description of the above embodiments, the outer shape of the cap body viewed in the axial direction has a flat shape as a whole. However, the outer shape of the cap body is not limited to a flat shape as long as it is a shape such that the rotational torque required for opening and closing can be obtained by the rotational force applied by the user. For example, it may be circular or polygonal. For example, it may be a shape in which a butterfly plate or the like protrudes from a cylinder in the radial direction.

In the description of the above embodiments, the nozzle 2A includes the plate-shaped portion 2*b*. However, in the above embodiments, since the plate-shaped portion 2*b* does not particularly have the function of a locking surface or a guide surface, if the first ratchet 6A and the second ratchet 6B can be formed, the plate-shaped portion 2*b* may not be provided.

The structure of a mouth plug portion and the package of the present invention may be configured by combining some configurations extracted from the above first and second embodiments. For example, although the length in the circumferential direction of the guide protrusion 5 of the first embodiment is less than that of the guide protrusion 5 of the second embodiment, the structure of a mouth plug portion and the package may be configured by combining the guide protrusion 5 of the first embodiment and the auxiliary protrusion 10 of the second embodiment. The guide protrusion 5 relatively long in the circumferential direction and the engagement protrusion 6 relatively long in the axial direction in the second embodiment may be applied to the structure of a mouth plug portion and the package of the first embodiment without applying the auxiliary protrusion 10 thereto.

The structure of a mouth plug portion and the package of the present invention may be configured by excluding some configurations from the first or second embodiment. For example, the structure of a mouth plug portion and the package may be configured by excluding the auxiliary protrusion 10 from the configuration of the second embodiment.

In the above embodiments, two sets of the guide protrusion 5 and the engagement protrusion 6 are provided in the nozzle 2A. However, three or more sets of the guide protrusion 5 and the engagement protrusion 6 may be provided in the nozzle 2A so as to have point symmetry with respect to the central axis O. Similarly, in the above embodiments, two sets of the flap 7 and the stopper 8 are provided in the cap body 3A. However, three or more sets of the flap 7 and the stopper 8 may be provided in the cap body 3A so as to have point symmetry with respect to the central axis O.

Description of Reference Signs

1 spout-attached pouch (package)
2 spout
2*a*, 2*e*, 3*c* outer peripheral surface
2A nozzle
2*b* plate-shaped portion
2B flange portion
2C attachment portion
2*d* second guide surface
3 cap
3*a*, 3*n* inner peripheral surface
3A cap body
3B tamper band
3C first band piece
3*d* rib
3D second band piece
3*f* seal body
3*g* flange
3*h* connection piece (weak portion)
3*i* linking piece (weak portion)
3*j* end surface
3*k* fixed connection portion
4 container body
5 guide protrusion (first outer protrusion)
5*a* lower surface (locking surface)
5*b* upper surface (first guide surface)
5*c* side surface
5*d* inclined end surface
5*c* inclined portion
5*f* first inclined surface
5*g* second inclined surface
6 engagement protrusion (third outer protrusion)
6A first ratchet (second outer protrusion)
6B second ratchet (second outer protrusion)
7 flap (first inner protrusion)
7*b* edge
8, 8', 8", 8''' stopper (second inner protrusion)
8*a* lower end surface
8*b* tip
8*c* first slope
8*d* second slope
9A first claw portion
9B second claw portion
10 auxiliary protrusion
10*a* inclined guide surface
e1 first end (top-side end)
e2 second end (base end-side end)
F1 first end
F2 second end
T top
O central axis
p1 pouring outlet
R1 rib-forming area
R2 rib-less area
S mouth plug portion

The invention claimed is:

1. A structure of a mouth plug portion comprising:

a tubular nozzle whose top is provided with an opening; and a cap that is detachably fitted to an outer periphery and the top of the nozzle and closes the opening when being attached to the nozzle, wherein the nozzle includes:

a first outer protrusion provided partially in a circumferential direction of an outer peripheral surface of the nozzle at a position away from the top in an axial direction and protruding outward in a radial direction, and a second outer protrusion provided at a position further than the first outer protrusion in the axial direction with respect to the top and protruding outward in the radial direction from the outer peripheral surface of the nozzle, the first outer protrusion includes:

a locking surface that locks the cap such that the cap is prevented from being pulled out, and a first guide surface spirally extending between the locking surface and the top, the cap includes:

a cap body configured to be attached to the nozzle so as to cover the first outer protrusion and the opening, and a tamper band connected to a base end side of the cap body and formed into an annular shape that laterally covers the second outer protrusion when the cap body is attached to the nozzle, part of the tamper band in the circumferential direction being provided with a weak portion configured to be broken by an external force received from the second outer protrusion when the cap body is rotated, the cap body includes:

a first inner protrusion that protrudes inward in the radial direction from an inner peripheral surface thereof and is configured to be locked on the locking surface when the cap body is attached to the nozzle, and a second inner protrusion that protrudes inward in the radial direction from the inner peripheral surface and is provided so as to be movable along the first guide surface in a state where the first inner protrusion is not locked on the locking surface, and the outer peripheral surface of the nozzle is provided with a second guide surface along which the first inner protrusion and the second inner protrusion move in the axial direction during attachment/detachment of the cap.

2. The structure of a mouth plug portion according to claim 1, wherein the nozzle further includes a third outer protrusion forming a fitting gap between the third outer protrusion and a top-side end that is one of two ends of the first outer protrusion in the circumferential direction, the first guide surface at the top-side end is closer to the top than the other end of the two ends, and the fitting gap allows the second inner protrusion of the cap body to be removably fitted thereinto.

3. The structure of a mouth plug portion according to claim 1, wherein the first inner protrusion is formed of a protrusion piece extending diagonally inward in the radial direction from a base end of the cap body.

4. The structure of a mouth plug portion according to claim 1, wherein a base end-side end is one of two ends of the first outer protrusion in the circumferential direction, the first guide surface at the base end-side end is further than the first guide surface at the other end of the two ends with respect to the top, and a protrusion amount of the first outer protrusion outward in the radial direction at the base end-side end and in the vicinity of the base end-side end gradually increases from the base end-side end to the other end on a distant side from the base end-side end in the circumferential direction.

5. The structure of a mouth plug portion according to claim 1, wherein an outer shape of the cap body when viewed in the axial direction of the cap body has a flat shape as a whole.

6. The structure of a mouth plug portion according to claim 1, wherein an outer shape of the cap body when viewed in the axial direction is formed into an elliptical shape by an outer peripheral surface of the cap body being provided with a plurality of ribs extending in the axial direction and having different protrusion amounts in the radial direction.

7. The structure of a mouth plug portion according to claim 6, wherein the outer peripheral surface of the cap body includes a first outer peripheral surface on a top side in the axial direction and a second outer peripheral surface on a base end side in the axial direction, the outer diameter of the first outer peripheral surface is less than that of the second outer peripheral surface, and part of the second outer peripheral surface with which a minor axis of the elliptical shape intersects is a rib-less area provided with no ribs.

8. The structure of a mouth plug portion according to claim 1, wherein the first outer protrusion includes a pair of first outer protrusions provided in the nozzle, the second outer protrusion includes a pair of second outer protrusions provided in the nozzle, and each pair of the first outer protrusions and the second outer protrusions have 180° rotationally symmetry in the circumferential direction such that the second guide surface is disposed therebetween, and the first inner protrusion and the second inner protrusion of the cap body are formed within a range less than or equal to a width of the second guide surface in the circumferential direction of the nozzle, the first inner protrusion includes a pair of first inner protrusions provided in the cap body, the second inner protrusion includes a pair of second inner protrusions provided in the cap body, and each pair of the first inner protrusions and the second inner protrusions have 180° rotationally symmetry in the circumferential direction of the cap body.

9. The structure of a mouth plug portion according to claim 1, wherein the nozzle further includes an auxiliary protrusion, and the auxiliary protrusion includes an inclined guide surface, the inclined guide surface extends from a position between the first outer protrusion and the second outer protrusion in the axial direction toward a base end-side end that is one of two ends of the first outer protrusion in the circumferential direction, the first guide surface at the base end-side end is further than the first guide surface at the other end of the two ends with respect to the top, and the first inner protrusion is movable while being into contact with the inclined guide surface.

10. A package comprising the structure of a mouth plug portion according to claim 1.

* * * * *